US005301506A

United States Patent [19]

Pettingill

[11] Patent Number: 5,301,506

[45] Date of Patent: Apr. 12, 1994

[54] THERMAL REGENERATIVE DEVICE

[76] Inventor: Tom K. Pettingill, P.O. Box 281, Norval, Ontario, Canada, L0P 1K0

[21] Appl. No.: 917,193

[22] Filed: Jul. 22, 1992

Related U.S. Application Data

[63] Continuation-in-part of Ser. No. 727,960, Jul. 10, 1991, abandoned, which is a continuation-in-part of Ser. No. 545,646, Jun. 29, 1990, abandoned.

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 1,275,507 | 8/1918 | Vuilleumier | 62/6 |
| 2,127,286 | 8/1938 | Bush | 62/6 |
| 2,567,454 | 9/1951 | Taconis | 62/6 |
| 3,413,814 | 12/1968 | Van Geuns | 62/6 |
| 3,698,182 | 10/1972 | Knoos | 62/6 |
| 4,819,439 | 4/1989 | Higham | 62/6 |

OTHER PUBLICATIONS

Stirling Engine Newsletter dated Nov. 1984 Evaluation of the Vuilleumier Heat Pump for Heating Applications Authors Mikko, Nykyri, Pekka, Hiismaki, report marked as No. 15, 1981.

A Thermally Acuated Heat Pump, F. X. Eder, 1982 Butterworth and Co., (Publishers) Ltd. and IIR.

*Primary Examiner*—Ronald C. Capossela

*Attorney, Agent, or Firm*—Blake, Cassels & Graydon

[57] ABSTRACT

Vuilleumier type heat pumps and other thermal regenerative devices of the same type are improved by the provision of agitation and circulation of the working fluid within the working spaces for greater efficiency of heat exchange to/from these spaces. The circulation may be by means of fans, with electric motors, jet circulators, controlled direct exit of the working fluid from displacers, rotor blades located on a shaft operated from outside the device and other suitable means. The device may be single- or multi-unit. It may provide power to drive itself and/or for other uses.

34 Claims, 16 Drawing Sheets

(a)
$V_H=0$
$M_H=0$
$V_I=0.412$
$M_I=0.370$
$V_C=0.588$
$M_C=0.630$
P=0.663
(b)
$V_H=0$
$M_H=0$
$V_I=1.000$
$M_I=1.000$
$V_C=0$
$M_C=0$
P=0.738
(c)
$V_H=0.412$
$M_H=0.204$
$V_I=0.588$
$M_I=0.796$
$V_C=0$
$M_C=0$
P=1.000
(d)
$V_H=0.412$
$M_H=0.176$
$V_I=0$
$M_I=0$
$V_C=0.588$
$M_C=0.824$
P=0.867
(e)=(a)
$V_H=0$
$M_H=0$
$V_I=0.412$
$M_I=0.370$
$V_C=0.588$
$M_C=0.630$
P=0.663

THERMAL REGENERATIVE DEVICE

This is a continuation-in-part of U.S. Ser. No. 727,960 filed Jul. 10, 1991, now abandoned, which is a continuation-in-part of U.S. Ser. No. 545,646, filed Jun. 29, 1990, now abandoned.

FIELD OF THE INVENTION

This invention relates to improved thermal regenerative devices. The invention relates especially to thermal regenerative devices such as the Vuilleumier heat pump or the Stirling engine.

BACKGROUND OF THE INVENTION

U.S. Pat. No. 1,275,507 issued August 1918 to Vuilleumier described a method of refrigeration based on heat pump technology. In very simple terms, Vuilleumier provided a one-phase refrigerator absorbing heat from a low temperature region and rejecting it to a higher temperature region. In practice, the Vuilleumier heat pump comprises a cold region, a hot region and a region of intermediate temperature, with a one-phase working fluid distributed throughout these three interconnected regions.

If the regions are regarded as cylinders for simplicity, the working fluid moves between a cold cylinder from which heat is withdrawn on one side of a first displacer to an intermediate cylinder to which heat is delivered on the other side of the first displacer. Similarly, the intermediate cylinder is separated from a hot cylinder in which the working fluid is driven between the hot cylinder on one side of a second displacer and the intermediate cylinder on the other side of the second displacer. The movement of the displacers changes the volumes of the different temperature regions relative to each other, with consequent changes in pressure. This drives the heat transfer. Although in theory two cycles of displacer operations are involved, in practice they are inter-dependent in an integrated device. The high and low temperature cylinders may be oriented at a 90° angle to each other for preferred heat transforming conditions.

The coefficient of performance of the original Vuilleumier heat pump was not high and, although some modifications to it were introduced (see, for example, U.S. Pat. No. 2,127,286 issued 1935 to Bush and U.S. Pat. No. 2,567,454 issued September 1951 to Taconis), interest in it lapsed.

Historically, further development of the Vuilleumier heat pump and Stirling devices might have occurred if it had not been for advances in vapour compression refrigeration and developments such as the Linde, Claude and Heylandt cycles which have had enormous application for cryogenics. Also for cryogenics, the simple reversed Stirling engine is recognized. But all four of these require input of mechanical energy, whereas the Vuilleumier device requires very little mechanical input whether it is to be used for heating, cooling or both.

More recently, the Vuilleumier heat pump has been used for refrigeration in aeronautical and space applications, where its ability to produce very low temperatures with little mechanical complication is of greater importance than economy. Additional advantages are that the Vuilleumier device may be small, quiet and relatively maintenance-free. Recent concern about energy conservation and pollution of the environment has revived interest in the Vuilleumier device as a heat pump for residential heating and other purposes.

Attempts have, therefore, been made to improve the efficiency of the Vuilleumier device. Eder, in an article in the *International Journal of Refrigeration* (Vol. 5, No. 2, pp. 86–90, 1982) that was originally presented at the 11R meeting in Essen FRG in September 1981, discusses the performance of a Vuilleumier device. Nykyri and Hiismäki, in a report of Technical Research Centre of Finland No. 15/81, evaluate the Vuilleumier heat pump for heating applications. Nykyri and Hiismäki consider that the practical coefficient of performance for a Vuilleumier heat pump is 1.9 or even lower when heat losses are taken into consideration. They conclude that the main problem with the Vuilleumier Pump is the heat exchange at the low and intermediate temperatures.

The Vuilleumier concept is adaptable to various primary heat sources and, unlike conventional heat pumps, does not require electricity as its main power source, although a small amount of electricity or other power may be necessary to drive the displacers. Thus, even at a coefficient of performance of below 1.9, the Vuilleumier concept has its attractions because it is powered mainly by heat, and because energy losses incurred in the production of electricity to run a conventional heat pump need not be incurred. Even so, the achievable coefficient of performance of Vuilleumier devices and the efficiency of associated thermal regenerative machines such as the Stirling engine are not especially advantageous.

SUMMARY OF THE INVENTION

In one aspect, the present invention provides a thermal regenerative device having a constant volume with a one-phase working fluid distributed throughout, having displacers to divide the volume into three chambers whose respective volumes are variable by the movement of the displacers between them, a heat exchanger for each chamber in thermal contact with the working fluid, thermal regenerators in contact with the working fluid in the chambers, diffuser means for the passage of working fluid between the chambers, and means for the agitation or for the correlation of working fluid in at least one of the chambers.

The working fluid in the three chambers of the device may be maintained respectively at a hot temperature, a cool temperature, and a temperature intermediate between the hot and cool temperatures. The movement of the displacers may produce changes in overall pressure within the device. A programme of displacer movements may be provided such that net heat is transferred from the cool chamber to the intermediate temperature chamber.

The agitation/circulation means for this device may be a fan, a forced flow nozzle or a plurality of nozzles that are located in an extension of the respective chamber and are externally powered. The agitation/circulation means may be means to control and direct the flow of working fluid exiting from the diffuser means. The device may have surfaces located and contoured to increase thermal contact of the working fluid with the heat exchangers.

The thermal regenerative device of the present invention may have an extension chamber having a piston movable therein and means to transmit work between the piston and the displacers. Portions of the work may be used internally or externally of the device.

At least two of the thermal regenerative devices of the present invention may be arranged in a multi-unit machine in which their respective hot chambers contact a heat source zone. The multi-unit machine may have an extension cylinder with a piston moveable therein and means to transmit work between the piston and the displacers. The extension chamber may connect the respective hot chambers of the component devices.

The device of the present invention may provide two cylinders, whose respective internal first end chambers are connected to form the intermediate temperature chamber, and whose second end chambers respectively form hot and cool chambers, the hot chamber being divided from the respective intermediate temperature chamber part by the hot end displacer and the cool chamber being divided from the respective intermediate temperature chamber part by the cool end displacer. The two cylinders may be aligned axially. Alternatively, they may be aligned at any other angle, for example, 90°. The intermediate temperature chamber may have a crank chamber for respective connecting rods of the displacers.

In another aspect, the present invention provides a method of transferring heat energy from a low temperature region to a higher temperature region using a thermal regenerative device having a constant volume with a one-phase working fluid distributed throughout, displacers to divide the volume into three chambers whose respective volumes are variable by the movement of the displacers between them, a heat exchanger for each chamber in thermal contact with the working fluid, thermal regenerators in contact with the working fluid in the chambers, and diffuser means for the passage of working fluid between the chambers, wherein the working fluid in the three chambers is maintained respectively at a hot temperature, a cool temperature, and a temperature intermediate between the hot and cool temperatures. This method has the steps of:

moving the displacers cyclically to raise and reduce overall pressure within the device with delivery of at least part of the heat of compression through the heat exchanger for the intermediate temperature chamber and with abstraction of at least part of the heat of expansion from the cool chamber, to abstract heat substantially isothermally from each of the hot chamber and the cool chamber and to deliver heat substantially isothermally to the heat exchanger for the intermediate temperature chamber; and agitating working fluid in at least one of the chambers to increase thermal contact of the working fluid with the respective heat exchanger.

In this method, there may be a hot end displacer located between the hot and intermediate temperature chambers and a cool end displacer located between the cool and intermediate temperature chambers, wherein said moving step has the following cycle:

moving the cool end displacer to enlarge the cool chamber, whereby a minor amount of heat is abstracted from the cool chamber to maintain the temperature of the cool chamber and to supply heat of expansion thereof;

moving the hot end displacer to substantially decrease the volume of the hot chamber, whereby a major amount of heat is abstracted from the cool chamber and overall pressure within the device is decreased;

moving the cool end displacer to reduce the cool chamber; and moving the hot end displacer to enlarge the hot chamber, whereby overall pressure within the device is increased and heat of compression is rejected through the heat exchanger for the intermediate temperature chamber.

According to this method, the fluid in the hot chamber, in the cold chamber or in the intermediate temperature chamber may be agitated. Agitation of working fluid may be by means of a circulating fan, a forced flow nozzle or a plurality of nozzles that are located in an extension of the respective chamber and are externally powered. Agitation may involve controlling and directing the flow of working fluid exiting from the diffuser means.

According to this aspect of the invention, an extension cylinder having a piston movable therein may be provided, and the method may have the step of transmitting work between the piston and the displacers. Work transmitted from the piston may be for use internally and/or externally of the device.

BRIEF DESCRIPTION OF THE DRAWINGS

Embodiments of the invention will now be described by way of example with reference to the drawings, in which.

DETAILED DESCRIPTION OF THE PREFERRED EMBODIMENTS

Figure 1:
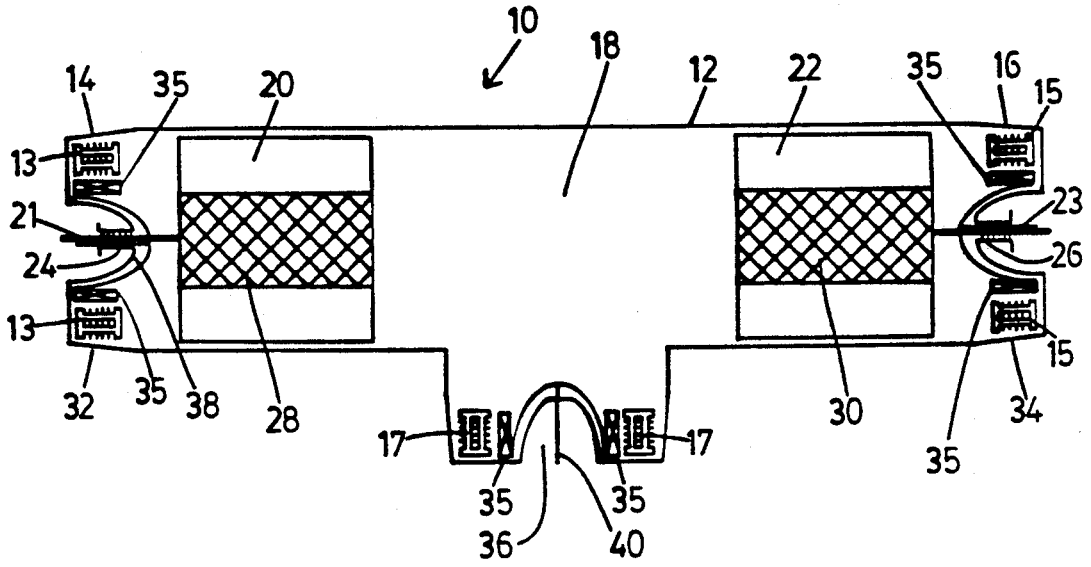
FIG. 1 is a diagrammatic representation of a thermal regenerative device according to the invention.

FIG. 1 depicts a one phase heat pump 10 comprising a cylinder 12 and containing working fluid throughout. A hot end 14 is heated from heat exchanger 13, a cool end 16 extracts heat from a cool region through heat exchanger 15, and an intermediate region 18 discharges heat through heat exchanger 17. Much of the following description is confined to consideration of a heat pump as in FIG. 1, in which displacers move coaxially. However, it is to be understood that other configurations such as those of FIGS. 3 and 4 and others are included within the scope of the invention. The differences in design and calculation are easily within the ability of those skilled in the art.

In FIG. 1, thermal regenerative displacers 20 and 22 shaped generally as pistons are located to separate the hot end 14 from the intermediate region 18 and the cool end 16 from the intermediate region 18, respectively. Each displacer varies the size of its adjacent chambers as it is reciprocated by its respective drive rod 21, 23 in the working fluid. The displacer drive rods 21, 23 enter the cylinder 12 through respective sealing glands 24, 26.

Figure 3:
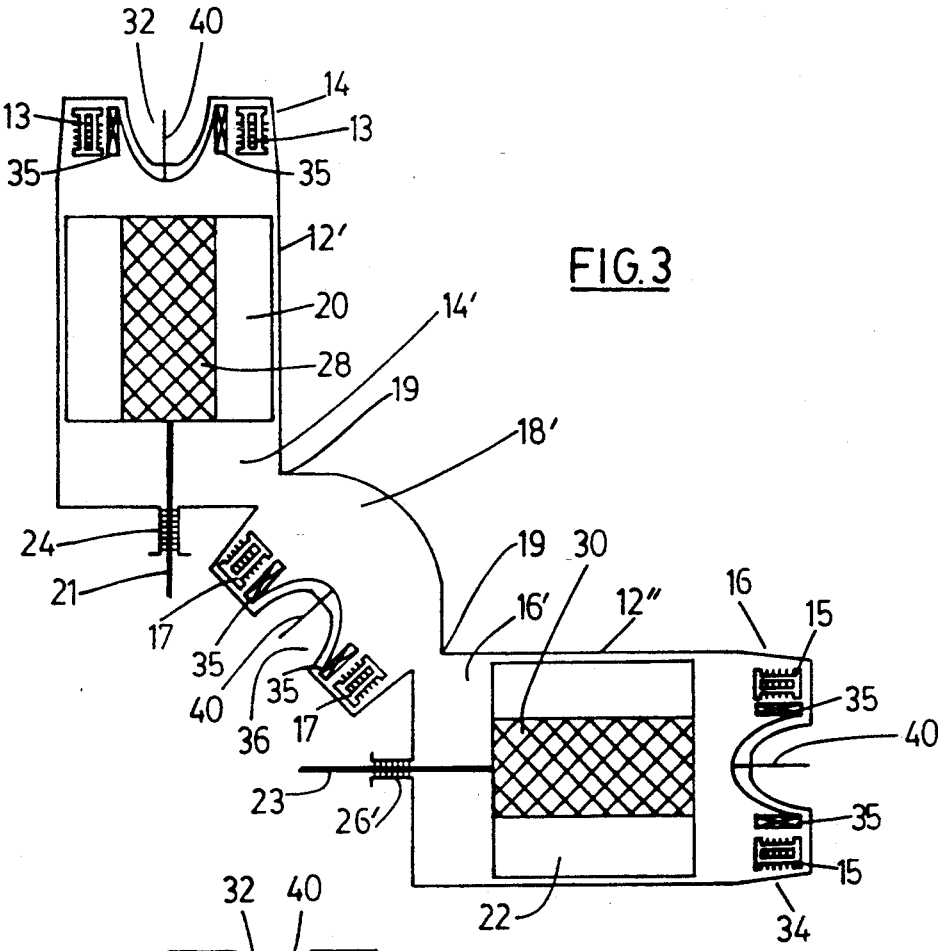
FIG. 3 is a similar diagrammatic representation of a third device according to the invention.
Figure 4:
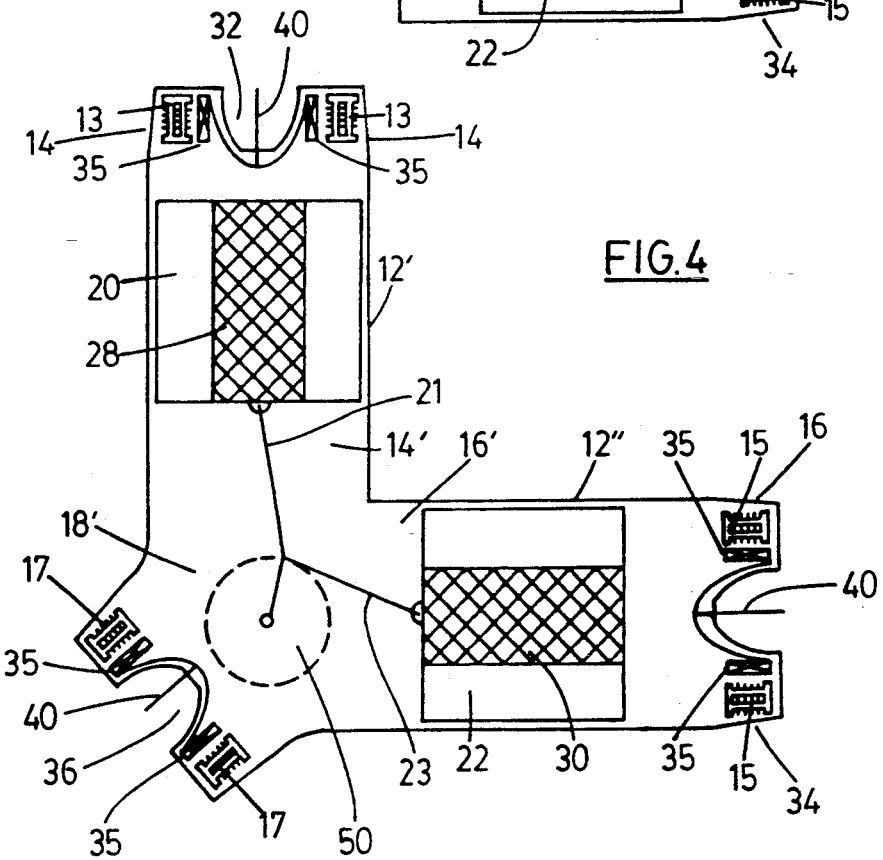
FIG. 4 is a similar diagrammatic representation of a fourth device according to the invention.
Figure 5:
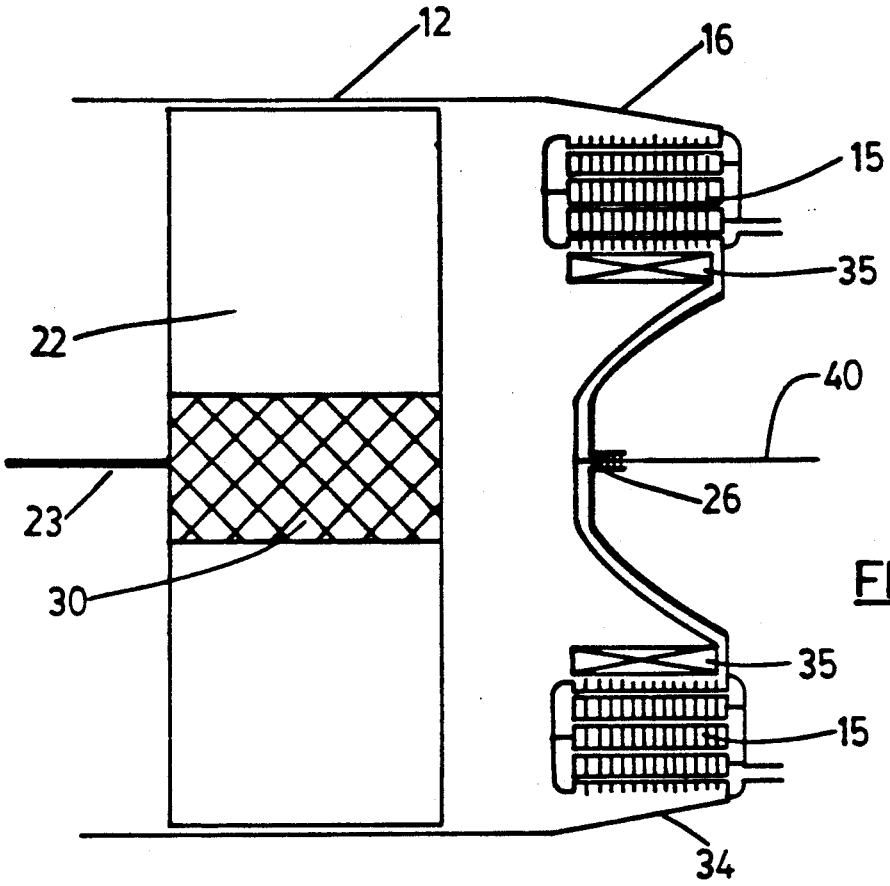
FIG. 5 shows an enlarged detail of the cool cylinder end of a device of FIGS. 2 or 3 (still diagrammatic)
Figure 6:
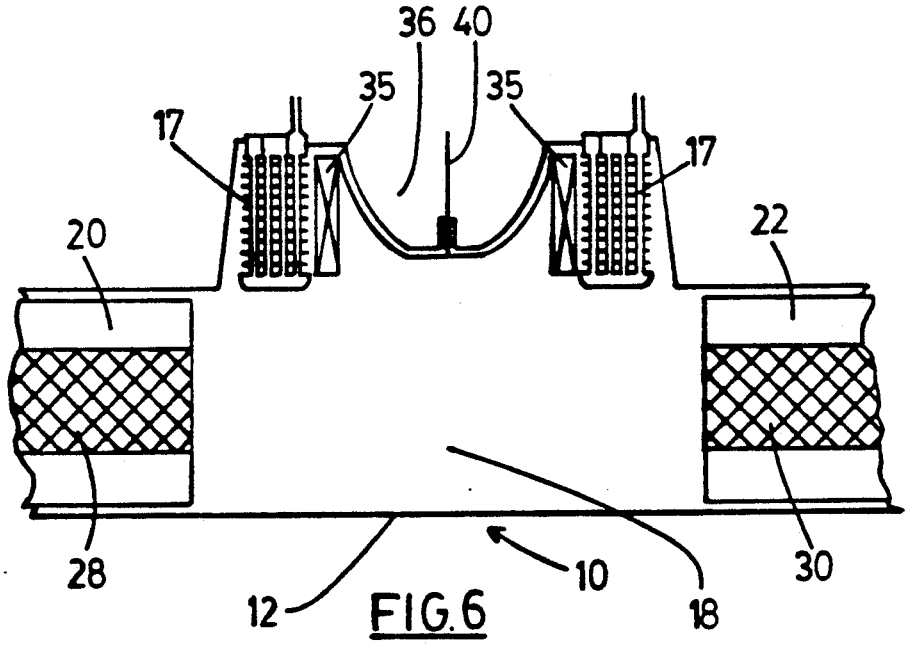
FIG. 6 shows an enlarged detail of the intermediate chamber of a device of FIG. 1 or 2, the displacers of the FIG. 1 embodiment being shown.

As shown in FIGS. 1, 3 and 4, each displacer is provided with a core 28, 30 of gas-porous material that acts as a diffusion channel to allow the displacement of working fluid between the hot end 14, the intermediate region 18 and the cool end 16. The temperature of the working fluid in each chamber is maintained so far as possible equal to that of respective service fluids through heat exchange surfaces 13, 17, 15 or by passing through core channels 28, 30.

Figure 2:
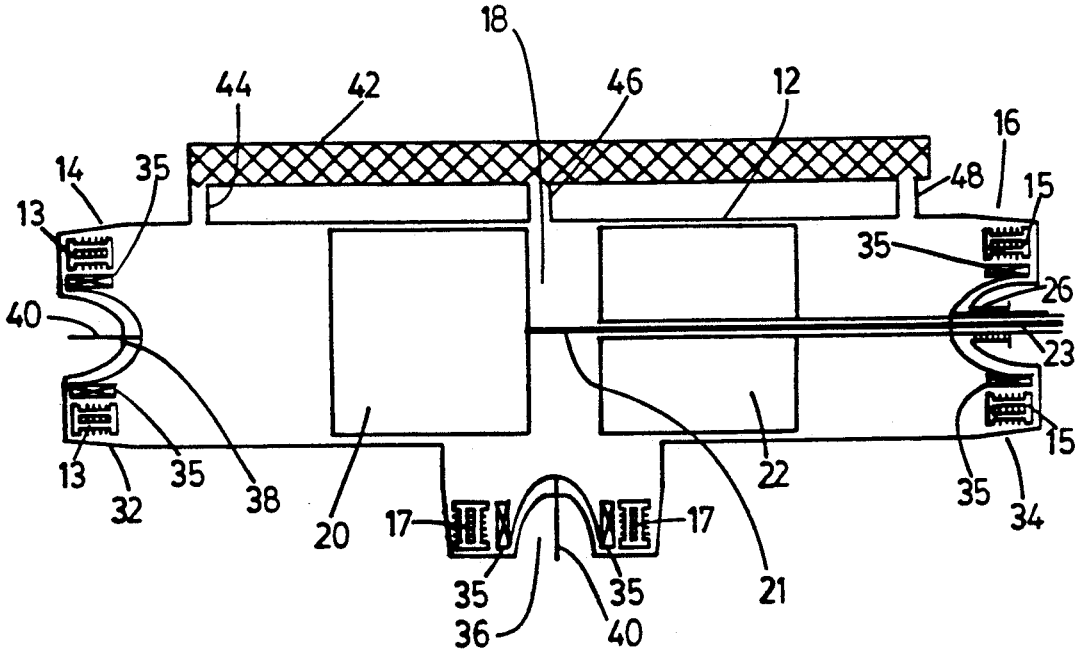
FIG. 2 is a similar diagrammatic representation of a second device according to the invention.

At each of the hot end 14 and the cool end 16, the cylinder 12 of FIG. 1 is contoured to provide an annular heat exchange chamber 32, 34, respectively. The intermediate region 18 is also provided with a heat exchange chamber 36 protruding from it. The shape of the heat exchange chamber 36 in FIGS. 1 and 2 is not limited by the need to provide a cylinder end. However, for consistency it is shown here as generally similar in shape to chambers 32, 34. Alternatively, it may be generally circular or of any other convenient shape. (Such convenience may be determined by ease of assembly, machining, etc.) Chamber 36 should, so far as possible, minimize dead space, e.g., volume not swept by the displacers, as is also generally the case for the other chambers.

As shown, the proportions of the hot end 14, the cool end 16 and the intermediate region 18 are not accurate. In fact, the intermediate region 18 will be comparatively narrower for greater efficiency and minimization of dead space. It is emphasized that all of the drawings are intended only to illustrate the principles of the invention and are not necessarily actual working drawings of suitable apparatus. In practice, considerable extra apparatus parts and detail may be necessary, as would be apparent to one skilled in the art. These parts may include, for example, suitable valves, seals, piston rings, fan rotors or displacer stops, depending upon the particular embodiment of the invention. In particular, suitable parts able to withstand heat are necessary at the hot end 14.

In FIGS. 1–6, a fan 35 is provided within the heat exchange chambers 32, 34, 36 for agitation/circulation of the working fluid. Preferably, a circulation-assisting device is present in all three chambers, though all three need not have the same type of device. (However, all three fans or other agitation means need not be present in certain other embodiments.) For designs having fan shafts 40 coaxial with the displacer drive rods, there is much to be said for using fan motors that are integral with their fans and located inside the cylinder ends or inside the chamber protruding from the intermediate region.

The provision of a high speed fan shaft associated with a reciprocating rod operating at high pressure mandates some care in the selection of sealing means. A turbine rotor could be attached to the fan shaft, preferably integral with the fan rotor. In the case of single unit machines, the turbine rotor would be supplied with fluid at a relatively higher pressure than that prevailing in the cylinder(s) from a small chamber with suitable charging and release valves that could be automatic or controlled from the displacer mechanism. During pressure rise the chamber would be charged. Later, when a suitable difference between the chamber pressure and the cylinder pressure had been attained, the chamber fluid would be released to the turbine rotor, giving an impulse to the turbine-circulator. The mass inevitably associated with the rotor constructions, together with their speed of operation, would ensure steady fluid circulation. For multi-unit machines, the pressure supply for the turbines could be taken from the companion unit or units (giving more than one impulse per cycle, if desired).

FIG. 2 shows a device somewhat similar to that of FIG. 1. In the device of FIG. 2, the displacers 20, 22 do not have gas-porous cores for the displacement of working fluid, but bypass conduit 42 is provided for this purposes. The bypass conduit 42 may include gas-porous material and is connected to the hot end 14, the intermediate region 18 and the cool end 16 through connections 44, 46, 48, respectively. The displacer rods 21, 23 are coaxial and both emerge from the cool end 16. (Other devices, not shown, may exist in which the seals about the displacer rods are not at the cool end, but at a different location, for example, the intermediate region.)

FIGS. 3 and 4 show further embodiments in which separate cylinders 12′ and 12″ are provided. In the device of FIG. 3, each cylinder 12′, 12″ is a closed cylinder connected to a separate intermediate chamber 18′. The entire intermediate region 18′ in this case comprises the ends 14′, 16′ of cylinders 12′, 12″ and the connecting passages 19.

In the device of FIG. 4, cylinders 12′, 12″ are open-ended, intermediate region 18′ being formed between them. Intermediate region 18′ houses a crank 50 that may be used to move displacers 20, 22 in any phase relationship depending on the position(s) of the connection point(s) of the displacer (i.e., connecting) rods 21, 23 to the crank. The phase relationship may further be controlled by the angle between the cylinders, which need not be 90° as shown. For optimum performance, the preferred displacer phase relationship for a crank-driven device is about 90°.

The devices of FIGS. 1 to 4 are merely representative of a variety of devices that may be used with the invention. It should also be remembered that the invention may be applied to heat engines, for example, to a Stirling heat engine.

The thermodynamic operation of any of the devices of FIGS. 1, 2, 3 or 4 may be better understood with reference to the example discussed below of a simplified machine having intermittent displacer motions. The phases of operation of such a machine are shown in FIGS. 7, 8, 9 and 10 and the simplified thermodynamic cycle of FIG. 11. In the following theoretical discussion, ideal conditions will be assumed for simplicity. It will be appreciated that, in practice, theoretically ideal conditions will not be obtainable.

It should be apparent from this discussion that, for each displacer movement, all surfaces that contain a volume must simultaneously give up heat to the working fluid or simultaneously extract heat from it, irrespective of the fact that their cyclic average makes them heat suppliers to the working fluid (the hot volume, $V_H$ and the cold volume, $V_C$) or heat removers from the working fluid (the volume at intermediate temperature, $V_I$).

PHASE 1

Figure 7:
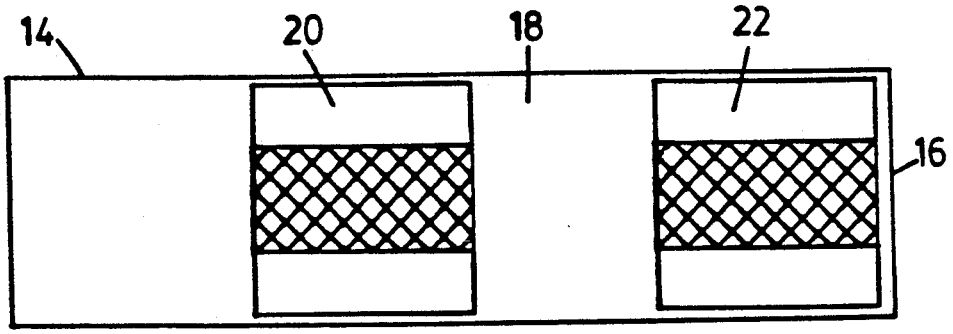
FIG. 7, 8, 9 and 10 are simplified diagrams of a heat pump of the general type used in the invention illustrating different displacer positions.

In FIG. 7, the hot end displacer 20 has just moved to the right to increase the volume $V_H$ of the hot end 14 at temperature $T_H$. Since a greater volume of the working fluid in the device as a whole is at high temperature, overall pressure increases to a maximum.

Figure 8:
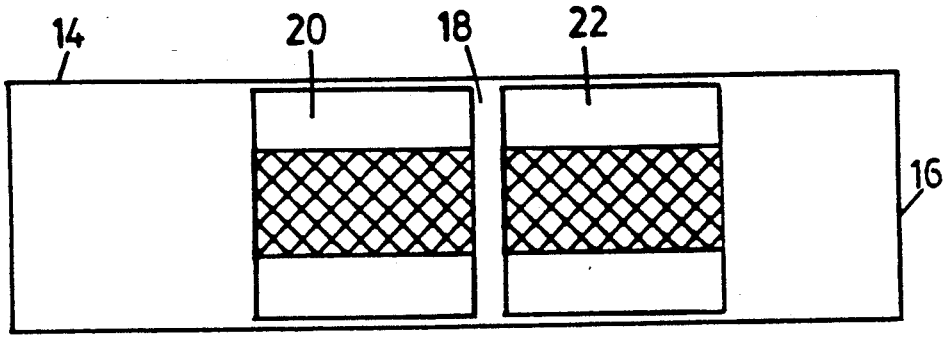

To achieve the position shown in FIG. 8, the cool end displacer 22 is moved to enlarge the cool chamber 16 having volume $V_C$ and to reduce the intermediate chamber 18 having volume $V_I$. Overall pressure in the device falls due to the presence of a larger volume of cool gas, to a level indicated by position VIII in FIG. 11. Thus, both heat and mass will tend to transfer from the intermediate chamber to the cool chamber. Heat transfer from the intermediate chamber to the cool chamber may be interrupted by the thermal regenerative displacer 22, such that the temperature of the working fluid tends to that of the regenerator as it flows through it. During this phase, the movement of a large portion of the mass of working fluid from the intermediate chamber at $T_I$ to the cool chamber at $T_C$ causes a slight pressure drop throughout the machine, with consequent slight heat gain by the working fluid at all heat exchanger surfaces.

PHASE 2

Figure 9:
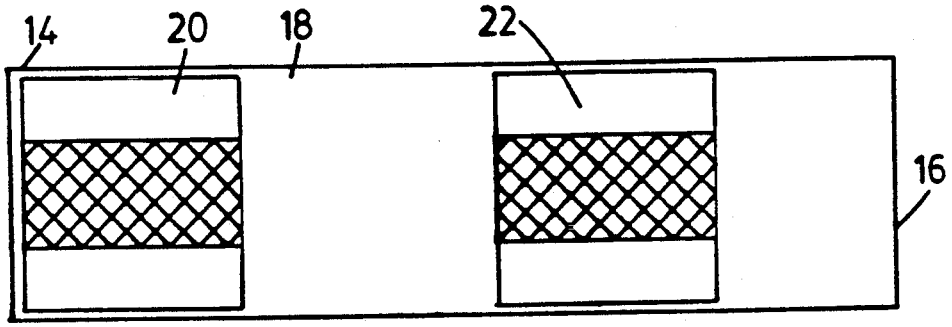

Between FIGS. 8 and 9, the hot end displacer 20 moves to reduce the size of the hot end chamber 14. The overall pressure attains its minimum cyclic value when the position of FIG. 9 is reached (See position IX in FIG. 11) because the cool end volume $V_C$ at temperature $T_C$ is at its cycle maximum while the volume $V_H$ at $T_H$ is at its cycle minimum. Because the pressure is falling and because of the substantially isothermal conditions in each space, most of the heat taken in by the working fluid in the cool end is taken in during this phase of displacer movements. Heat is also taken in by the working fluid that is in the hot chamber, while heat is given up to the hot regenerative displacer by the working fluid that is displaced through it. Similarly, the volume of working fluid $V_I$ at temperature $T_I$ takes up heat, whereas the cool regenerative displacer 22 rejects heat into the working fluid. Later on in the cycle, of course, all of these effects are reversed.

PHASE 3

Figure 10:
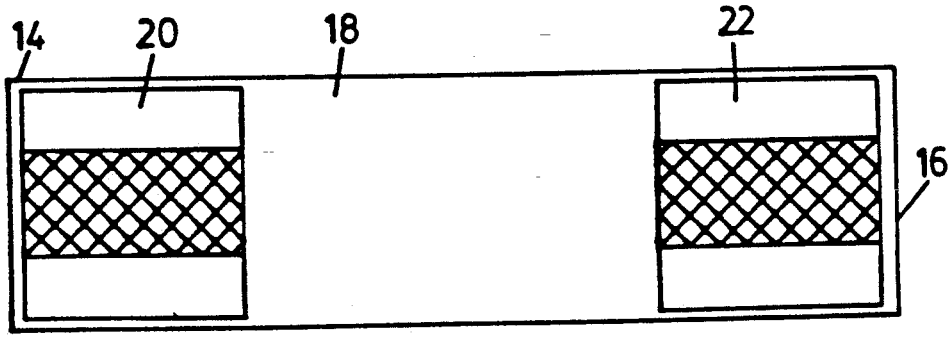

Between the positions of FIGS. 9 and 10, the hot end displacer 20 remains stationary, while the cool end displacer moves most of the working fluid from the cool end 16 to the intermediate chamber 18. Mass flows from the cool end sufficient to take up the volume $V_I$ at temperature $T_I$ in FIG. 10. Since the intermediate chamber 18 is warmer than the cool end 16, the pressure rises slightly. (Again, because the pressure is rising—and is uniform throughout—all surfaces that contain a volume will absorb heat in differing amounts from the working fluid.) The thermal regenerative displacer 22 will tend to be cooled as the mass passes through it, with the mass, correspondingly, tending to be warmed from the cool end temperature to the intermediate temperature. Since the intermediate chamber is maintained at temperature $T_I$, heat is transferred out of the intermediate chamber through heat exchanger 17.

PHASE 4

The final step is to return to the displacer positions of FIG. 7 by moving the hot end displacer 20 toward the intermediate chamber 18. The mass of gas moving from the intermediate chamber 18 to the hot chamber 14 through the thermal regenerator is relatively small, but due to the high temperature of the hot chamber it expands to its maximum volume. (The volume change will be that of the volume change between the chambers, neglecting any rod effects). Again, overall pressure in the device rises to a maximum when the hot chamber 14 is at its maximum size. As the pressure rises, all surfaces absorb heat from the working fluid. Heat is absorbed substantially isothermally by the hot chamber 14 through heat exchange surfaces 13. During this displacer stroke the heat exchange surfaces 17 of the intermediate chamber perform the main part of their function in discharging heat from the device at temperature $T_I$.

Figure 11:
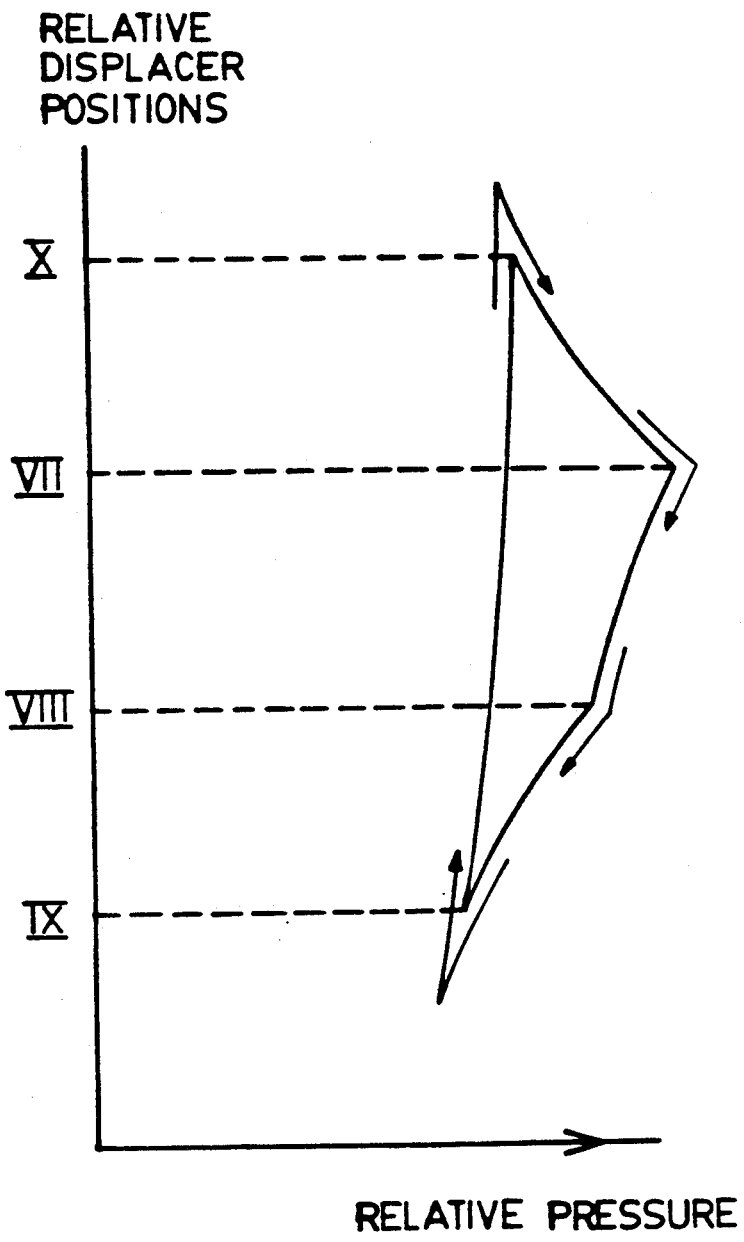
FIG. 11 is a pressure diagram of the phases involved in a device according to the invention, and as depicted in FIGS. 7, 8, 9 and 10.

In practice, the relative pressures at the various displacer positions may be quite different from those shown in FIG. 11 for a machine having different ratios between the temperatures of its three regions. (In fact, if temperatures $T_I$ and $T_C$ were very close, the cool end regenerator might be greatly reduced in size or perhaps even omitted, and the machine would still function.)

The existence of dead space is inevitable and results in some negative heat flow. ("Negative" here is used to mean reversed from the predominant direction of flow.) Dead space may include heat exchangers, fans, connecting passages and the regenerators themselves. When heat transfer occurs, there must be some temperature difference across the heat exchangers and these differences represent irreversibilities. The overlapping of processes that occurs with crank-slider approximations also causes significant negative heat flows. This will be a factor in optimizing the kinematics of this machine, one that might be at least partially overcome by the use of cams.

Figure 14:
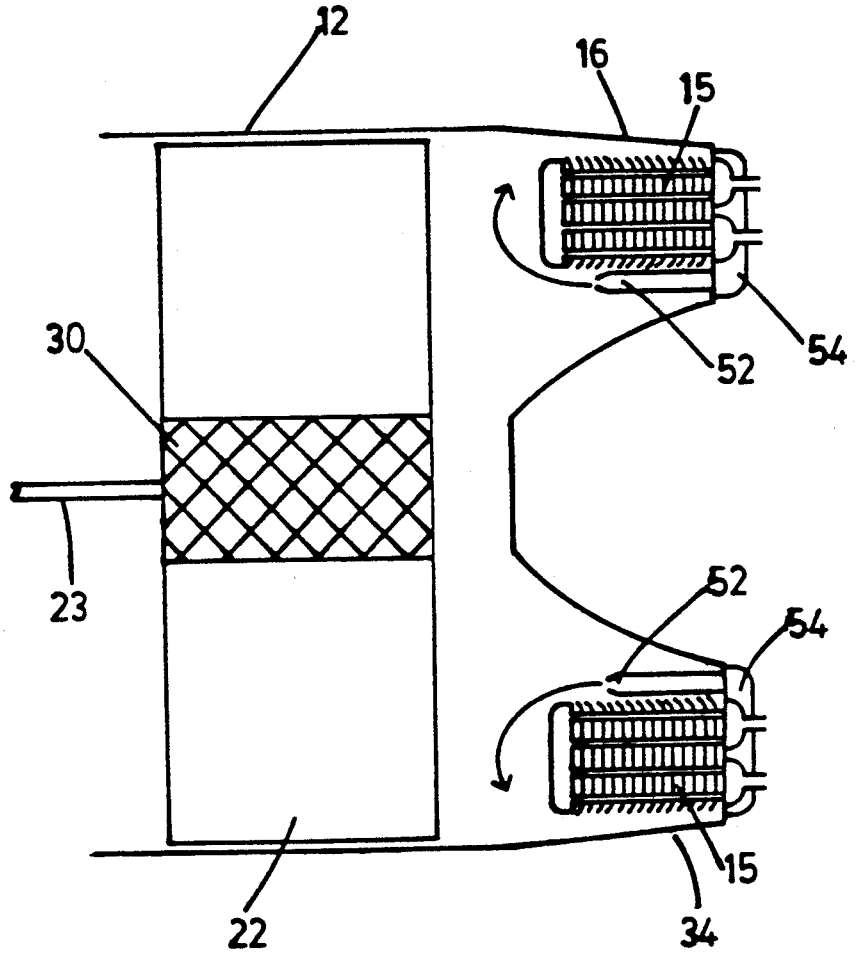
FIG. 14 is a detail of a seventh embodiment of the invention.
Figure 15:
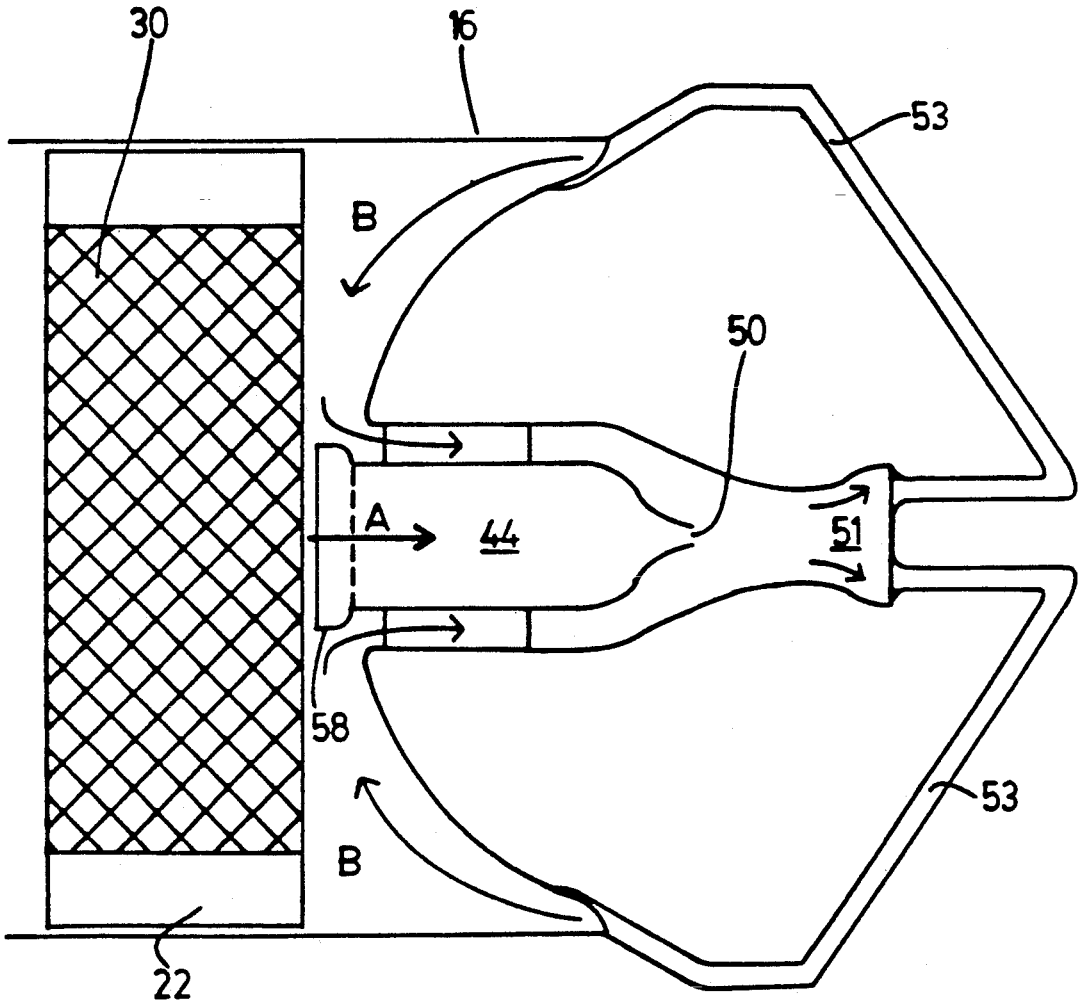
FIG. 15 is a detail of an eighth embodiment of the invention.
Figure 16:
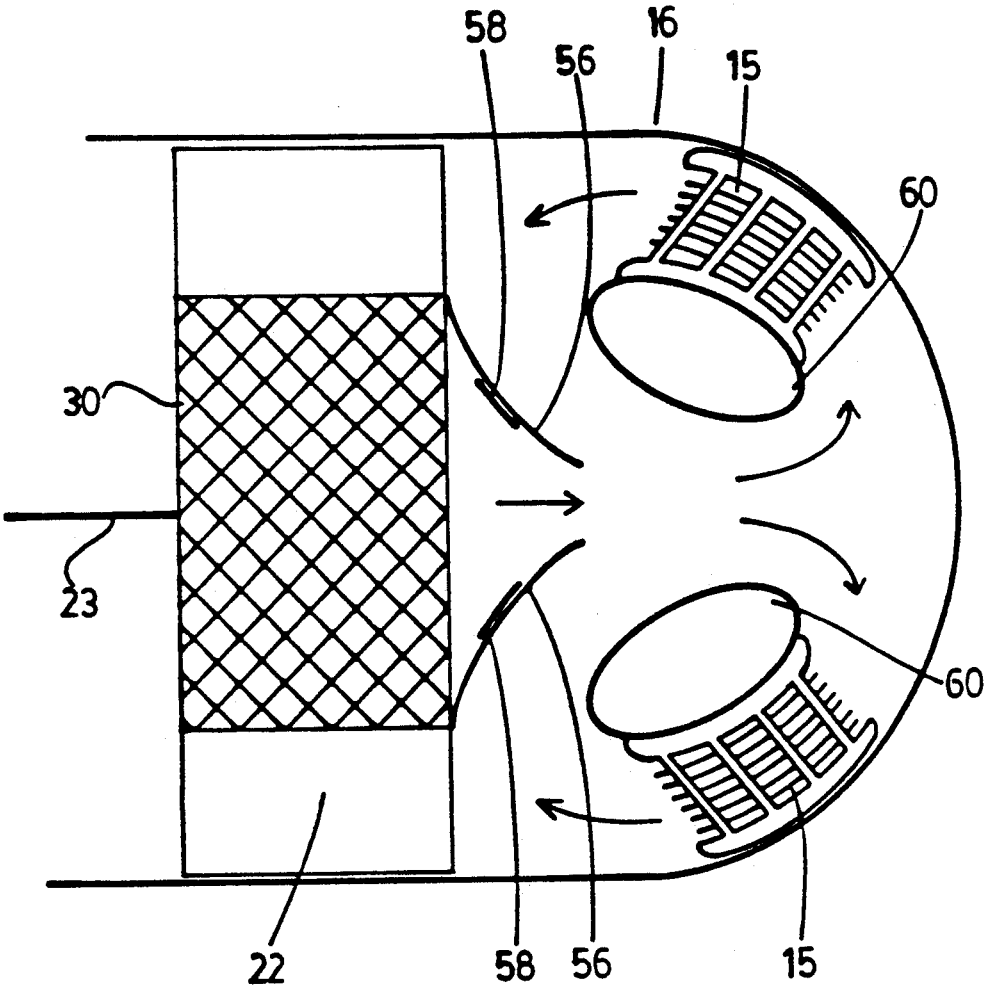
FIG. 16 is a detail of a ninth embodiment of the invention.

Instead of a fan for forcing the circulation of the working fluid, a jet circulator (i.e., injector or ejector) might be used (See FIGS. 14, 15 and 16). Its nozzle may be oriented inside or outside, or in either direction, depending on the desired direction of working fluid flow. Jet circulators are not restricted to a particular cylinder end. As indicated previously, certain embodiments of the invention may have jet circulators for all the chambers, whereas other embodiments may have a jet circulator for one space and a fan for another.

FIG. 14 shows a cool end 16 of a device according to the invention having a displacer 22 and a heat exchanger 15. A ring of jet circulator nozzles 52 is arranged in the doughnut-shaped end inside heat exchanger surface 15. The jet circulator nozzles 52 are connected to a header 54, all of which is shown simplistically with the understanding that working arrangements may be made in any convenient manner. In operation, working fluid is injected through jet circulator nozzles 52, causing flow in the direction of the arrows. This agitation is designed to increase circulation of the working fluid in the chamber over the heat exchange surfaces 15, with a view to maximizing heat exchange. (Although FIG. 14 shows an embodiment of the present invention in which the displacer rod does not pass through the cylinder end depicted, the use of jet circulator nozzles is not restricted to this configuration, and they may be used where the displacer rod passes through the cylinder end.)

The arrangement of FIG. 15 differs from that of FIG. 14 in that most of the circulation equipment is provided outside the cylinder. Nozzle 50 draws fluid from storage chamber 44 and injects it under pressure into plenum chamber 51 in the direction of arrow A. This induces flow of further fluid around heat exchange tubes 53, as shown by arrows B. The storage chamber 44 may be charged by a non-return or mechanically operated (including electromagnetic) valve 58, or by the momentary attainment of a suitable relationship between the pressure in the chamber and that in the cylinder. Although FIG. 15 shows the cool end 16, this jet circulation design may serve at the intermediate region 18, and is particularly suitable for the hot end, due to the interposition of the heat exchange surface between the actual cylinder end and the heat source. An embodiment of the invention may also exist in which the circulation equipment outside the cylinder is still integral with the cylinder and is part of the pressure-containing system.

The arrangement of FIG. 16 differs from that of FIGS. 14 and 15 in that (i) the cylinder end shown is outwardly domed; (ii) jet circulator nozzle 56 draws fluid directly from the displacer's gas-porous core 30; and (iii) non-return valves 58, which may be flap valves, return some of the working fluid to the displacer 22 on its back stroke (which is from left to right). The working fluid flows in the direction shown by the arrows, resulting in improved circulation at the heat exchanger 15 around annular body 60. On the displacer's back stroke, the central arrow would reverse. (Again, the nozzle of FIG. 16 is not restricted to the cylinder end configuration shown, and may be used in the case where the displacer rod passes through the cylinder end.)

Figure 12:
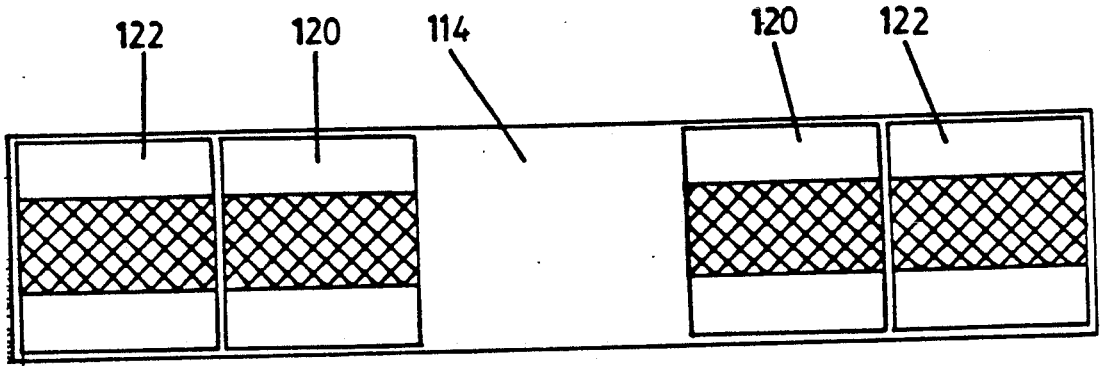
FIG. 12 is a simplified diagram of a fifth embodiment of the invention.
Figure 13:
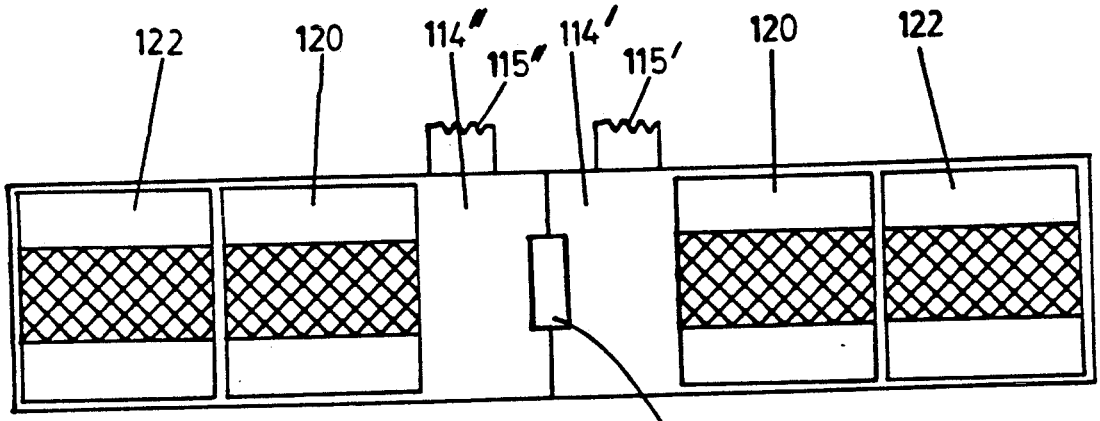
FIG. 13 is a simplified diagram of a sixth embodiment of the invention.

Very large machines have relatively large reciprocating masses and inertia forces, and there could be situations where some balancing would be essential. This may be achieved by building a balanced machine end-to-end with a common hot space 114 as shown in FIGS. 12 and 13. Such a machine would also have the advantage of not requiring a hot closure at one end. The two sets of displacers 120, 122 would have equal and opposite movements; thus dynamic forces would be largely balanced out. The end-to-end arrangement can be designed to give better performance through two stages, as shown in FIG. 13, where the hot space 114 is divided into subspaces 114' and 114'' and working fluid may be passed between these subspaces in either direction. A regenerator 100 may be provided between spaces 114' and 114'', and heat exchangers 115' and 115'' in contact with circulating working fluid are also provided.

Multi-unit machines may also use the jet circulator means described for FIGS. 14, 15 and 16. When a machine having a jet circulator nozzle 50 as in FIG. 15 has more than two units, the fluid supply could be taken from one or more of the other cylinders, eliminating the necessity for a storage chamber 44. If more than one other cylinder is used, each of these cylinders could be associated (but would not have to be) with its own nozzles, which would be designed to suit the fluid mass flow rate required and the prevailing pressures.

Heat sources for devices according to the present invention may include the burning of fossil fuels, wherein the high temperature of the combustion products is used to heat the hot space $V_H$.In multi-unit machines, the combustion products from one unit may be passed to an adjacent unit (possibly with additional fuel being burnt). Such an arrangement might be in series or series-parallel combinations. In heating the hot space, the combustion products lose heat, but in most applications would still be very hot. If these very hot gases were to be discharged to waste, a lot of heat would be lost and the efficiency of the device or its coefficient of performance as a heat pump would be greatly reduced. This problem could be largely rectified by heat exchanging the gases with the air that is to be used for combustion, so that effectively almost all of the heat of combustion is supplied to the machine at a high temperature. The exhaust gases might also be used to heat the service fluid for the intermediate region.

Alternatively, the discharge exhaust gas from an engine (or some portion of it) may be used as the heat source to drive the device. For the case of a single unit machine, the effective temperature of this heat supply would be somewhat lower than the exit temperature of the heat source gases from the heat pump. If, however, two heat pumps were used and their heat supply sources were connected in series, the mean temperature for the total performance would be higher. If the heat pump is required for refrigeration and there is a significant temperature difference between the cold fluid inlet and outlet connections, then the cold fluids could also be in series.

Any implication herein that the present invention is concerned only with "straight cylinder" layouts is not intended. The ideas can be applied to other devices where hot, intermediate and cool volumes are produced by mechanical means. For example:

a) Volumes may be produced by oscillating vanes in a cylinder. Wurm (U.S. Pat. 3,716,988, 1973) proposes such blades as part of a thermodynamic machine. Also Knöos (U.S. Pat. 3,698,I82, 1972) uses both ends of a single "diametral" vane for a "hot gas engine or refrigerating machine".

b) Separate cylinders may be used, one for each of the three volumes, connected together by (external) regenerators. In this case, the displacers would be pistons. The three cylinders (or 6, 9, etc. for multi-unit machines) could be structurally assembled in any convenient way, e.g., "in line" or "barrel", each cylinder having its own fan or jet circulator.

c) The simple expedient of placing the heat transfer surfaces outside the cylinders in series with the regenerators, as in modern Stirling engines, is also possible. (However, Stirling engines lack the circulatory devices of the present invention.) Such a scheme cannot give isothermal conditions, but the overall effect may improve the fluid movement and heat exchange over surface areas achieved by the traditional Vuilleumier machine.

d) For individual heat exchangers, it may be possible to make a complete circuit with its corresponding cylinder volume by using a fan or jet circulator, with all feasible combinations of internal/external heat exchangers, internal (i.e., displacer carried)/external regenerators, fan/jet circulator and regenerator "connections" to the circuits at suitable points.

Numerical Example of Cyclic Pressure and Mass Distribution Variation

Figure 17:
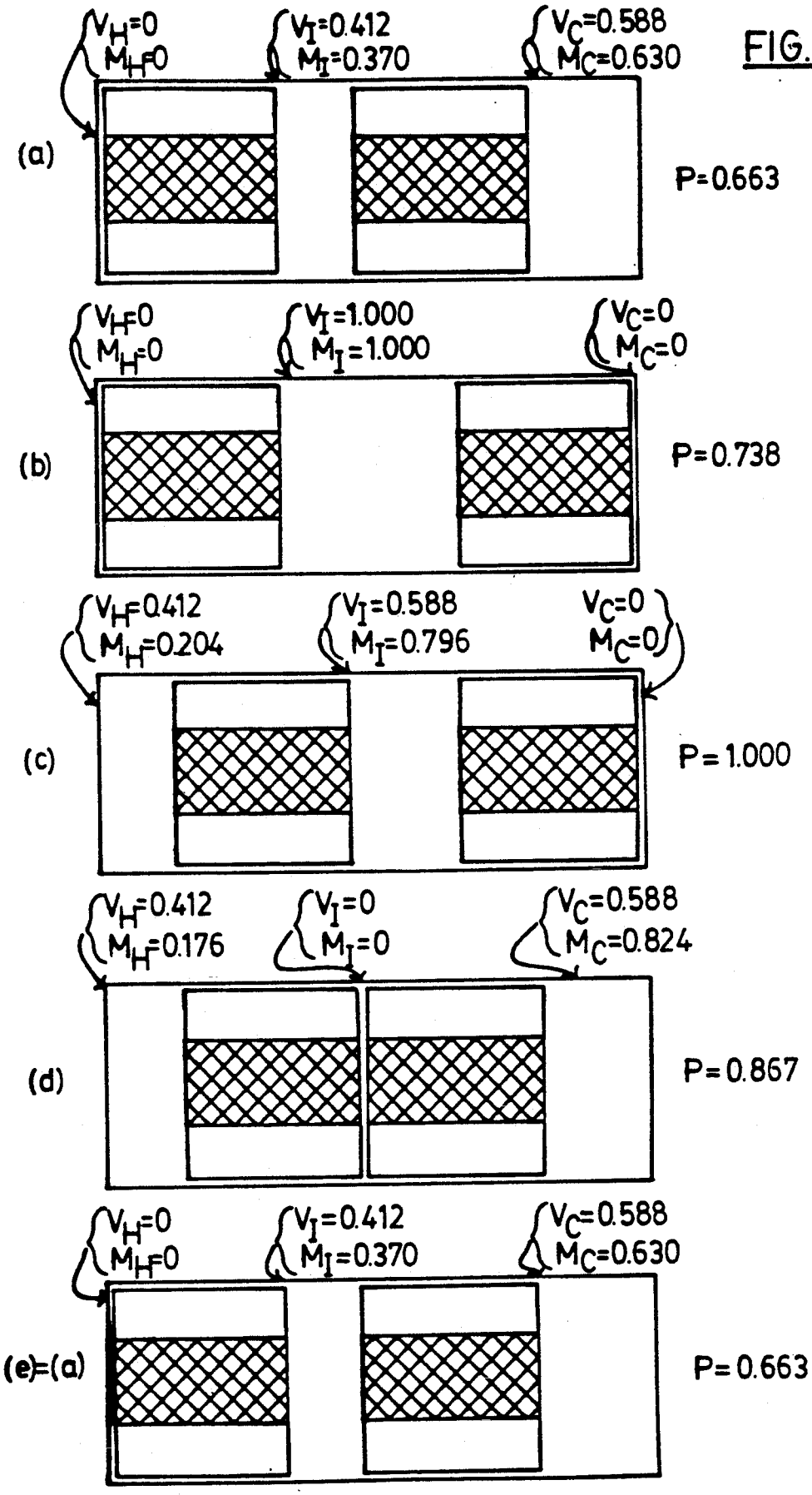
FIG. 17 is a series of sketches for use with the specific numerical example in the detailed description of the embodiments.

Reference is made to FIG. 17 a), b), c), d) and e). For clarity, all dead spaces are neglected. Moreover, the cyclic operation of the displacers will not necessarily sweep the volumes exemplified. Such volumes will be determined in practice for optimum performance. The motion of the displacers will not be absolutely sharply intermittent for practical reasons. However, for ease of exemplary calculation, the simplest case will be assumed. For this example, the following are assumed:

Total swept volume equals unity
Hot end displacer swept volume $V_H = 0.70$ of cool end displacer swept volume $V_C$
It follows that the swept volumes are:
$V_H = 0.412$
$V_C = 0.588$
Temperatures: $T_H = 850$ K., $T_I = 310$ K., $T_C = 260$ K.
(All temperatures are absolute.)

The relative mass distribution for a total mass of unity and the instantaneous pressure relative to the peak cycle pressure will be found for the salient points in the cycle.

Beginning with the Ideal Gas Equation, the expression for pressure becomes:

$$P = \frac{mR}{\frac{V_H}{T_H} + \frac{V_I}{T_I} + \frac{V_C}{T_C}} \quad mR \text{ is a constant}$$

P, for the sequence of intermittent displacer movements used, will have its peak value when $V_C$ is zero and $V_H$ is at its maximum, i.e., 0.412. Therefore, $$V_I = 1 - 0.412 = 0.588$$

Then, for P to have its peak value of 1, the constant mR becomes $$1\left(\frac{0.412}{850} + \frac{0.588}{310} + \frac{0}{260}\right) = 0.002381$$

That is, $$P = \frac{0.002381}{\frac{V_H}{T_H} + \frac{V_I}{T_I} + \frac{V_C}{T_C}}$$

The individual relative masses become, for any point in the cycle, $$M_H = \frac{\frac{PV_H}{RT_H}}{\frac{PV_H}{RT_H} + \frac{PV_I}{RT_I} + \frac{PV_C}{RT_C}}$$

i.e.,

-continued $$M_H = \frac{\frac{V_H}{T_H}}{\frac{V_H}{T_H} + \frac{V_I}{T_I} + \frac{V_C}{T_C}}, \quad \text{similarly for } M_I \text{ and } M_C$$

Commencing the cycle at a), the cool space has its maximum volume of 0.588, the hot volume is zero and the intermediate volume is 0.418.

$$P = \frac{0.002381}{\frac{0}{850} + \frac{0.412}{310} + \frac{0.588}{260}} = 0.663$$

$$M_H = \frac{\frac{0}{850}}{\frac{0}{850} + \frac{0.412}{310} + \frac{0.588}{260}} = 0$$

$$M_I = \frac{\frac{0.412}{310}}{\frac{0}{850} + \frac{0.412}{310} + \frac{0.588}{260}} = 0.370$$

$$M_C = \frac{\frac{0.588}{260}}{\frac{0}{850} + \frac{0.412}{310} + \frac{0.588}{260}} = 0.630$$

Between (a) and (b), the cool end mass is transferred to $V_I$ and its temperature rises to 310 K.

For the situation at (b), $$P = \frac{0.002381}{\frac{0}{850} + \frac{1}{310} + \frac{0}{260}} = 0.738$$

$$M_H = \frac{\frac{0}{850}}{\frac{0}{850} + \frac{1}{310} + \frac{0}{260}} = 0$$

$$M_I = \frac{\frac{1}{310}}{\frac{0}{850} + \frac{1}{310} + \frac{0}{260}} = 1.000$$

$$M_C = \frac{\frac{0}{260}}{\frac{0}{850} + \frac{1}{310} + \frac{0}{260}} = 0$$

Between (b) and (c), the fluid in the intermediate region is compressed by the movement of the hot end displacer, which causes a redistribution of mass. The pressure rises considerably and most of the heat discharged from the machine is discharged during this movement.

$$P = \frac{0.002381}{\frac{0.412}{850} + \frac{0.588}{310} + \frac{0}{260}} = 1.000$$

$$M_H = \frac{\frac{0.412}{850}}{\frac{0.412}{850} + \frac{0.588}{310} + \frac{0}{260}} = 0.204$$

$$M_I = \frac{\frac{0.588}{310}}{\frac{0.412}{850} + \frac{0.588}{310} + \frac{0}{260}} = 0.796$$

$$M_C = \frac{\frac{0}{260}}{\frac{0.412}{850} + \frac{0.588}{310} + \frac{0}{260}} = 0$$

Between (c) and (d), the cool end displacer moves to transfer the compressed gas in the intermediate region to the cool space. (Due to the slight fall in pressure, a small amount of working fluid is also transferred from the hot space so that the cool mass is slightly greater than the mass in the intermediate region in (c) above.)

$$P = \frac{0.002381}{\frac{0.412}{850} + \frac{0}{310} + \frac{0.588}{260}} = 0.867$$

$$M_H = \frac{\frac{0.412}{850}}{\frac{0.412}{850} + \frac{0}{310} + \frac{0.588}{260}} = 0.176$$

$$M_I = 0$$

$$M_C = \frac{\frac{0.588}{260}}{\frac{0.412}{850} + \frac{0}{310} + \frac{0.588}{260}} = 0.824$$

Most of the pressure drop occurs between (d) and (e), and therefore most of the heat input at $T_C$ occurs during this movement as a result of the isothermal expansion of the gas in $V_C$. We are now back to the beginning of the cycle.

$$P=0.663$$

(The pressure and mass variations will be affected by dead space.)

The heat pumping capacity of the machine may, of course, be controlled by adjusting the mass of working fluid in it, as well as by varying speed. It is not intended to restrict the use of this invention to intermittent displacer motions as in the above example. Alternatively, continuous motions and/or dwells may be used. By giving the displacers a different motion programme, the heat pumping action may be reduced.

The foregoing description, which concentrates mainly on the embodiments of FIGS. 1–17, is largely concerned with operating environments of the invention, although physical apparatus features and feasibility of construction are considered. FIGS. 18–23 illustrate embodiments of the invention in which physical apparatus features are considered in more detail.

Figure 18:
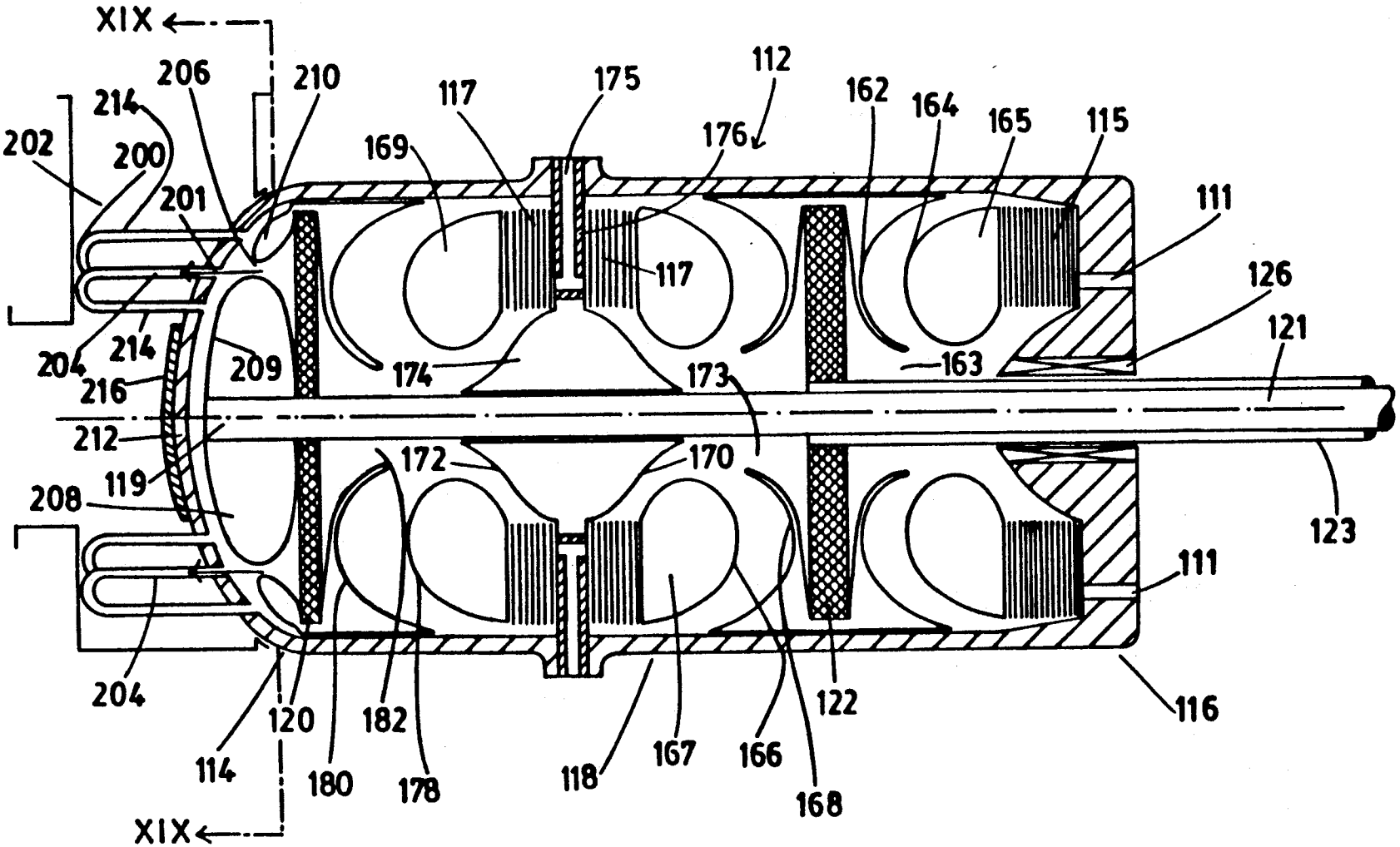
FIG. 18 is a longitudinal section through a practical embodiment of the invention.

FIG. 18 shows a cylinder 112 having working fluid being subjected to displacement between a hot end 114 and a cool end 116 through an intermediate region 118. Thermal regenerative displacers 120 and 122 are shaped generally as pistons and separate the hot end 114 from the intermediate region 118, and the cool end 116 from the intermediate region 118, respectively.

Both displacers 120, 122 may be formed from a gas-porous matrix such as wire mesh made from, for example, stainless steel. Inconel or coated materials such as galvanized steel are other materials that may be appropriate for the wire mesh of the cool end displacer 122. It may be possible to make the gas-porous matrix self-supporting and able to withstand the alternating forces across it by sintering the layers of wire mesh together, or by lightly pressure welding the layers together, i.e., making spot welds where crossing wires touch, each weld being so light that there is not undue thermal conductivity over the temperature gradient. The mesh size selected may vary, but it is Possible that a mesh Pitch of 0.1 to 0.5 mm. with wire diameter of 0.04 to 0.24 mm. may be suitable for air, atmospheric nitrogen or lighter gases such as helium or hydrogen. Other possible materials may include, but are not restricted to, wound ribbon matrices or a suitable type of porous metal having interconnecting passages.

In the embodiment of the invention shown in FIG. 18, drive rod 121 for displacer 120 is located coaxially within a channel of displacer drive rod 123 for displacer 122. Both rods 121, 123 emerge from cool end 116 through a suitable sealing gland 126, which allows for movement of rod 123 without appreciable loss of gas from cylinder 112. A sealing gland is also necessary between the rods 121, 123 but this is omitted from the drawing for simplicity. Sealing glands are necessary at all locations where moving parts enter the system. (In other, similar embodiments of this machine, the rods and seals may have different locations.)

Cool end 116 may comprise an annular chamber surrounding sealing gland 126, which is located through an inwardly convex and suitably strengthened end wall of cylinder 112. Heat exchanger 115 comprises a ring within the annular chamber of cool end 116. The heat exchanger 115 may include spaced apart annular plates stacked with the axis of the ring coincident with the axis of cylinder 112 and in conducting relationship with channels carrying service fluid. Service fluid for the heat exchanger 115 may be circulated into and away from the heat exchange surfaces through bores 111 in the cool end 116 of cylinder 112.

To provide for circulation of working fluid, an annular extension guide surface 162 for working fluid is provided at cool end 116. Guide surface 162 is concave toward cool end 116, its central aperture forming a nozzle 163. Displacer rods 121, 123 pass coaxially through nozzle 163. A narrow exit part of the nozzle 163 directs working fluid that has passed through displacer 122 from the intermediate region 118 through the centre of the heat exchanger ring 115. This fluid is then guided by the inwardly convex part of the end wall of cylinder 112. The heat exchanger 115 is provided with an annular flow guide surface 164 which is convex towards the intermediate region 118 and somewhat similar in contour to surface 162. It is preferred that the guide surfaces are arranged to avoid undue suction as the surfaces are drawn apart, although such forces may enhance fluid circulation. In the illustrated embodiment, surfaces 162, 164 are somewhat similar in shape, although the clearance between concave guide surface 162 and convex guide surface 164 may increase slightly in the radial inward direction, that is, in the direction of fluid flow towards the longitudinal center of the cylinder. These guide surfaces do not actually touch during operation. The guide surface 164 may be the surface of a generally doughnut-shaped annulus 165, which acts as an extension heat exchanger to the stacked plates 115 by channeling heat exchange fluid through its interior. (The "stacked plates" structure could of course be replaced by a precision casting.) The inner radius of the annulus 165 may be less than that of heat exchanger 115. The diameter of the narrow exit part of nozzle 163 may be generally similar to the diameter of the central aperture of annulus 165 so that, when surfaces 164 and 162 approach each other, the central aperture of the annulus 165 forms an extension of nozzle 163. Exact equality of the diameter of nozzle 163 and the inner diameter of guide surface 164 may not, however, necessarily be the best relation when initiating injection through the nozzle early in the stroke of the displacer 122.

The complementary convex and concave guide surfaces described here and below are so designed to optimize flow passages while keeping dead space low. Alternatively, other suitable flow directing contours may be employed, e.g., flared bell shapes. In the same vein, the cylinder cool end 116 is not restricted to the straight shape of FIG. 18, as long as good flow passages are provided.

Nozzle shape is not restricted to circular. Other nozzle shapes, for example, lobed nozzles, may improve agitation from the jet circulator, though experimentation on this point would be required. Multiple smaller nozzles, perhaps arranged in a ring, may also be suitable.

As displacer 122 moves away from heat exchanger 115, working fluid flows through nozzle 163 directed through the central aperture of the ring of heat exchanger 115, and thereafter past heat exchange surfaces of heat exchanger 115 to return along the passage between guide surfaces 162, 164. This passage expands as displacer 122 withdraws from the cool end. As displacer 122 moves towards the heat exchanger surface 115, working fluid will be drawn back through nozzle 163. Initially, flow may be from both sides of the heat exchanger 115 depending on the configuration of the flow passages and the nozzle 163. However, as displacer 122 moves to close guide surface 162 towards guide surface 164, the flow of working fluid tends progressively to concentrate through the central opening of the heat exchanger 115 and back through nozzle 163.

There may be appreciable Pressure losses when working fluid goes "backwards" through the nozzle 163. Efforts should be made to minimize these losses, for example, by rounding the edge of nozzle 163 and possibly by using one-way valves for the return of working fluid in addition to nozzle 163.

Heat exchangers 17 in FIGS. 1–4 and 6 were shown very diagrammatically offset from cylinder 12. In practice, an arrangement along the lines illustrated in FIGS. 18 and 20 may be useful. Stacks of spaced apart annular heat exchange plates comprise heat exchanger 117 generally similar to heat exchanger 115. Heat exchanger 117 is located within the cylinder 112 in the intermediate region 118. Service fluid for withdrawing heat energy from the intermediate region 118 is supplied and removed through bores 175 in the legs of a spider 176 for supporting heat exchanger 117. The spider 176 may be, for example, located about midway along the cylinder 112 and about midway along the stacked plates of heat exchanger 117. However, its location would actually be determined by the desired ratio of hot swept volume to cool swept volume.

Figure 20:
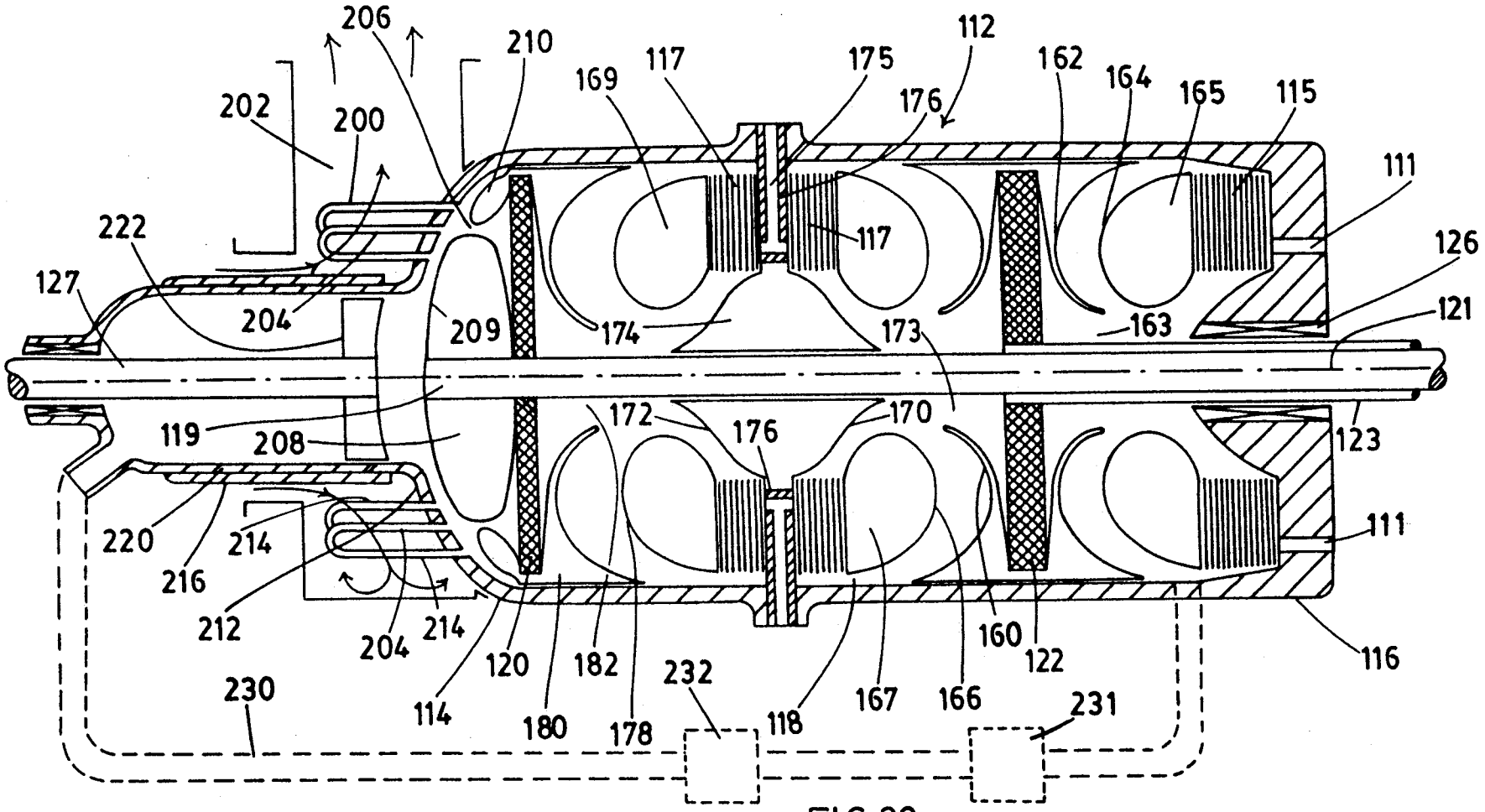
FIG. 20 is a longitudinal section of a modification of the apparatus of FIG. 18.

The service fluid of heat exchanger 117 may be circulated in any chosen flow path believed advantageous, although FIGS. 18 and 20 show very simplified arrangements. For example, it may be efficient to circulate the service fluid first through the cool facing part of heat exchanger 117 and then through the hot facing part of heat exchanger 117.

Space on both sides of the spider constitutes the intermediate region 118, and free passage must be allowed between these two sides for continuous mass redistribution between the hot, cool and intermediate chambers. Equalizing the pressure between hot and cool ends of the device may take place around the legs of the spider 176 or, if the spider 176 is of homogeneous construction, through ports in it.

Agitation and circulation of working fluid in the intermediate region 118 may be by means of further guide surfaces to direct flow of working fluid across the heat exchanger 117. For example, each face of heat exchanger 117 may be provided with annular doughnut-shaped guides 167, 169 generally similar to guide annulus 165 and approximately symmetrical to each other. The guide annulus 167 may have a convex guide surface 166 corresponding to an annular concave guide surface 168 carried by displacer 122. The annular concave guide surface 168 is similar to and approximately symmetrical with concave guide surface 162 and Provides nozzle 173 similar to and approximately symmetrical with nozzle 163. The operation of guide surfaces 166, 168 is generally similar to that of the guide surfaces 162, 164. An additional guide surface 170 may be provided in the intermediate region 118 to divert the annular core stream of working fluid from nozzle 173 away from direct passage towards the hot end 114 and towards the heat exchanger 117. Thus, working fluid is directed to circulate through the right side of heat exchanger 117.

Guide surfaces 170 and 172, oppositely directed from each other, are each provided by inner ring 174 of the spider 176 within the intermediate region 118. Suitably the radial cross-section of the inner ring 174 that gives rise to guide surfaces 170, 172 is that of a flared bell. Ring 174 may also serve as a housing for a guide bearing for displacer rod 121.

Like guide annulus 165, guide annuli 167, 169 may have service fluid channelled through their interiors such that guide surfaces 166, 178 act as additional heat exchange surfaces. Moreover, inner ring 174 and the convex inner wall of cool end 116 may be respectively cooled or heated by service fluid.

Guide surface 172 and guide surface 178 of guide annulus 169, together with concave guide surface 180 that forms nozzle 182 carried by displacer 120 Provide agitation and circulation means for working fluid entering the intermediate region 118 from the hot end 114. The operation of these guides for working fluid from the hot end 114 is similar to that described for guide surfaces 166, 168, 170 and nozzle 173 for working fluid from the cool end 116.

Heat exchange at the hot end 114 may operate differently than at the cool end 116 and in the intermediate region 118. Where the medium supplying heat to the hot end 114 is gaseous and at relatively low pressure, for example, combustion gases at atmospheric pressure, the type of compact heat exchangers used for the cool and intermediate regions are not practicable, due to the great bulk of the gases. At the hot end 114, it is more suitable to pass working fluid directly through heat exchange tubes 200 that project into a heat source zone 202 containing hot combustion gases.

FIGS. 18 and 20 show a plurality of heat exchange tubes 200 that project from an annular region at the hot end 114 of the cylinder 112. In these embodiments of the invention, heat exchange tubes 200 are U-shaped, having two legs, though other configurations would be suitable in combination with appropriate nozzle(s). The tubes 200 open at the free end of each leg into the hot end 114 for removal and return of working fluid. The openings of each removal leg 204 are arranged about a circle to receive working fluid from an annular nozzle 206 carried by the displacer 120.

The annular nozzle 206 is formed between a convex disc 208 (which may be hollow) carried by displacer rod 121 and an annulus 210 carried by displacer 120.

The disc 208 has two convex surfaces 209, one of which is opposed to and generally corresponds to the shape of a generally domed end wall 212 of the hot end 114. The other surface 209 of disc 208, which is closer to displacer 120, need only be sufficiently convex to allow working fluid through displacer 120. Thus, as illustrated, displacer rod 121 may extend through displacer 120 so that its one end 119 projects therefrom and near the hot end. Disc 208 is mounted on projecting rod end 119 so that it is close enough to the displacer 120 to minimize dead space while allowing working fluid to flow through the displacer 120. It is, of course, necessary to provide suitable mounting points for the displacer rods. The displacers may thus have solid centers.

Figure 21:
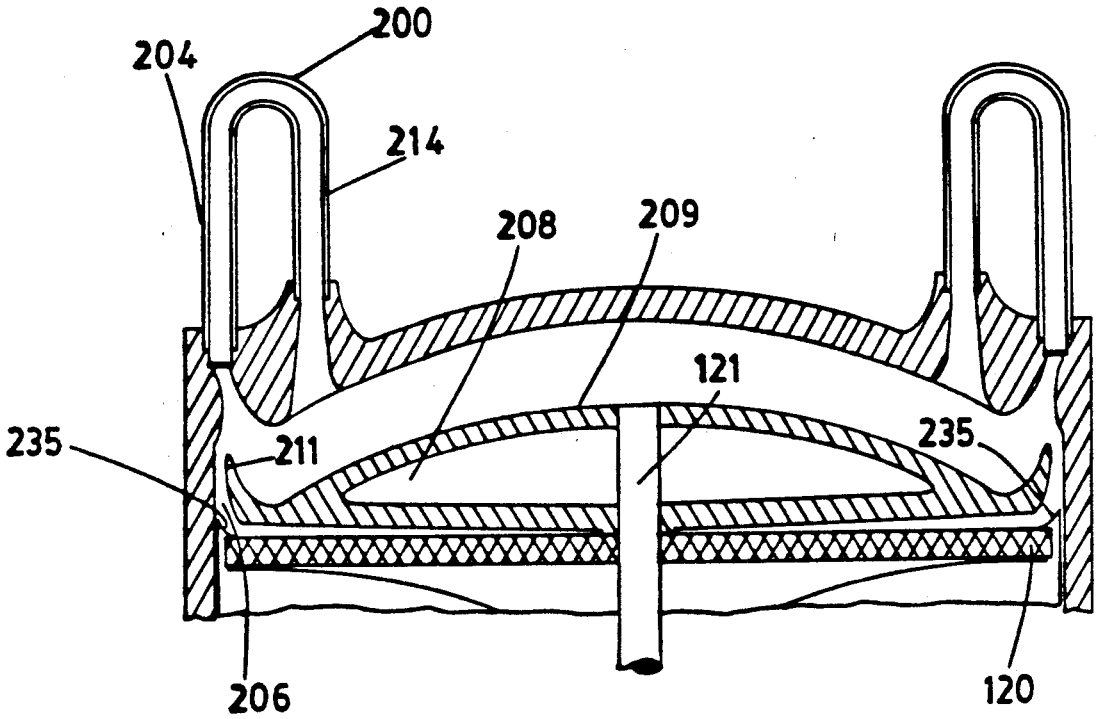
FIG. 21 is a detail of a modification of the apparatus of FIG. 18.

FIG. 21 shows in detail certain modifications to the device of FIG. 18. The nozzle 206 is at the periphery of cylinder 112, and its structure may be such as to impart a slight swirl to the working fluid to stabilize flow.

Referring again to FIGS. 18 and 20, as the side of the thermal regenerative displacer 120 near the hot end 114 is very hot, it may not be easy to provide good non-return valves. Thus, it may be desirable to make this nozzle fairly efficient in reverse flow. This is helped by the convex shapes of surface 209 and annulus 210 having suitable radii for an easy entry into the nozzle when the flow is reversed from the direction indicated by the arrow. Their contour and tapering should also be suitable for re-expansion as the working fluid goes towards the gas-porous matrix, without too much pressure loss. In other embodiments of the invention (not shown), multiple discrete nozzles are provided, and the same care must be had in the design of flow paths.

Figure 19:
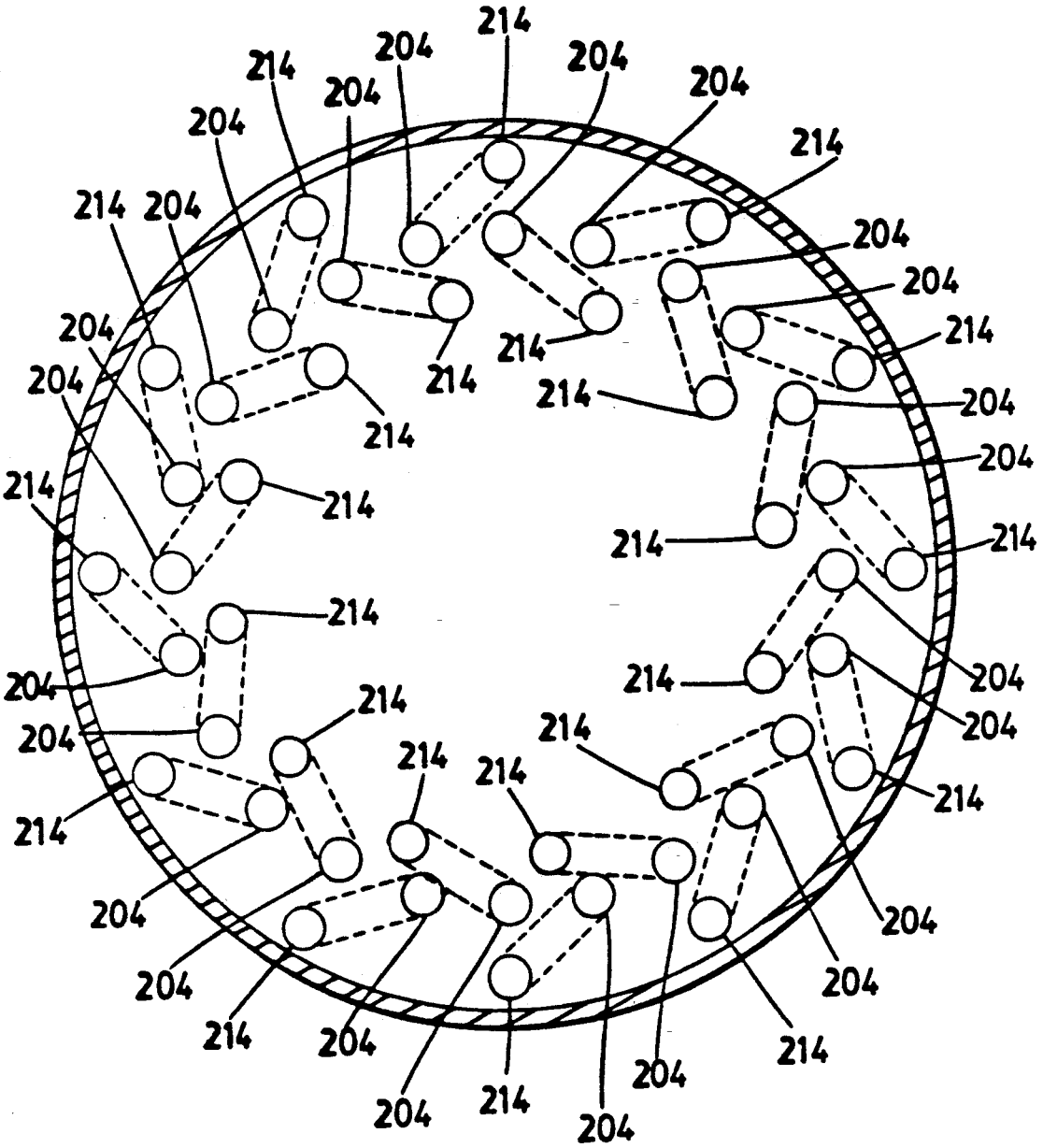
FIG. 19 is an axial view from the inside of the hot end wall of the apparatus of FIG. 18.

The working fluid enters the hot end 114 through displacer 120 in a wide annular stream that rapidly narrows to flow through the annular nozzle 206 between disc 208 and annulus 210. Working fluid emerging from the nozzle 206 as an annular curtain of gas enters heat exchange tubes 200 at the removal legs 204 aligned with nozzle 206. The working fluid returns to hot end 114 of cylinder 112 by return legs 214 that are alternately located radially outwards and inwards of the circle of removal legs 204. An axial view of the inside of domed end wall 212 showing the pattern of removal and return legs 204, 214 of tubes 200 is shown in FIG. 19.

The alternating of inner and outer legs 214 results in the return of two curtains of heated working fluid sandwiching the curtain of gas leaving through legs 204. Thus, flow from the nozzle into the tube inlet is not disrupted, given, of course, a suitable diameter of the tube inlet circle relative to the cylinder diameter.

Since the domed wall 212 and the heat exchange tubes 200 project into a hot environment of, for example, 1,000 K, it may be desirable to provide a heat shield 216 for the domed wall 212. For ease of illustration, in FIG. 18 the heat shield 216 is indicated only at the crown of domed wall 212, though it will in fact be provided over any suitable area. The heat exchange tubes 200, on the other hand, must be made of a material able to withstand the temperature to which they will be subjected.

Energy input is required to move displacers 120, 122 of FIG. 18. At least some of this energy may be provided by the modification shown in FIG. 20, a self-driving machine. To be self-driving, i.e., require no external mechanical power, the machine must generate sufficient mechanical power to overcome losses, which are mainly due to pressure loss across regenerator displacers and nozzles, and sliding friction of seals. This mechanical power may be produced by cyclically allowing the total volume of the working fluid to expand, followed by compression. Net work is produced if the mean pressure during expansion is greater than that during compression. A power piston and cylinder expansion may be connected to any part of the machine to provide the power, the piston being suitably connected to the mechanism that operates the displacers and the piston's movement being dependent on the displacer movements.

FIG. 20 shows cylinder 112, which is similar to that of FIG. 18 except for the Provision at domed end 212 of a power piston 222 and cylinder 220 device to move displacers 120, 122. This arrangement is a modification of the constant volume device so far described. FIG. 20 illustrates a machine that is not a constant volume device as described by Vuilleumier; nor is it a Stirling engine. Rather, the present invention, while integrating aspects of these devices, advances the ideas behind them.

Cylinder 220 opens into hot end 114 at domed end of cylinder 112 and passes through heat source zone 202. Heat source zone 202 may be, in two examples, a combustion gas zone or a zone receiving heat from a solar concentrator. The outer surface of cylinder 220 within zone 202 and any remaining surface of domed end 212 may be provided with a heat shield 216 if desired.

Inside cylinder 220, power piston 222 on rod 127 is designed to move in accordance with pressure changes within cylinder 112. The outward movement of piston 222 when the pressure in cylinder 112 is high does work that is then fed into the machine by any convenient means.

Means may be provided, as indicated by line 230 (in phantom) in FIG. 20, to lead back into the system any leakage past power piston 222. A one-way valve 231 is provided in the line 230 to prevent pressure transfer in the wrong direction. If a further one-way valve 232 is used with a significant, though not necessarily large, volume between valves 231 and 232, then, depending on the "unseating" pressure differences required for the valves, the maximum pressure behind piston 222 will tend to approach the minimum cycle pressure in main cylinder 112. In multi-unit machines, the spaces behind the power piston may be connected together, reducing or obviating the need for incorporating additional volume.

In another embodiment of the self-driving machine (not shown), the nozzle 206 may be positioned at the periphery of cylinder 112, as shown in FIG. 21 for the non-self-driving machine. This position provides more room for the power piston 222 and obviates the need to modify the diameter of nozzle 206 if there is significant movement of the power piston while the hot end displacer 120 moves to enlarge the hot space. (Such modification would be necessary for the nozzles 206 shown in FIGS. 18 and 20.) In yet another embodiment of the invention (not shown), a peripheral ring of multiple discrete nozzles could be employed.

Figure 22:
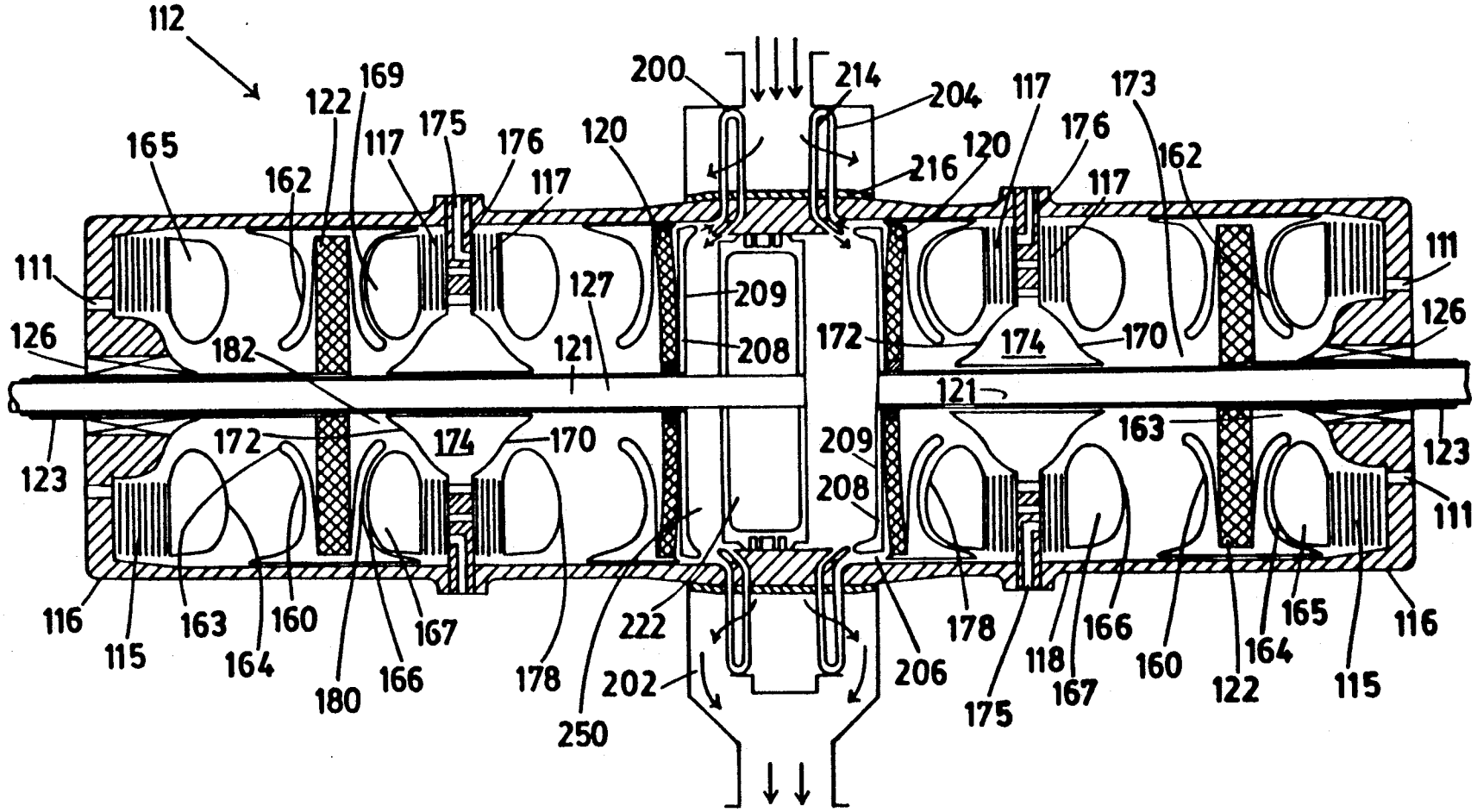
FIG. 22 is a longitudinal section of a modification of the apparatus of FIG. 20.

Apparatus as shown in FIGS. 20 and 22 may be self-driving after warm-up. In most instances, it may be possible to start up the machine using an electric motor, manually, or by standby engines.

FIG. 22 illustrates the use of two self-driving apparatuses "back-to-back", with the consequent need for only one double-acting power piston 222 instead of two single-acting pistons like piston 222 of FIG. 20. In this device, double-acting piston 222, instead of being set to operate in an extension cylinder of small diameter, is located in a mid portion 250 of the main cylinder between the two "back-to-back" apparatuses. Moreover, only one hot end interface is necessary, rather than two. (It may be seen that the device of FIG. 22 may offer advantages in manufacturing ease and in efficiency.)

The construction of the "back-to-back" device is generally symmetrical, apart from the necessary provision of power piston rod 127. The power piston rod 127 emerges from one end of the device coaxially with the displacer drive rods 121, 123 and is connected to the displacer rod actuating mechanism in any convenient manner. Phase difference between the two ends of this device may suitably be 180°.

Service fluids supplied to heat exchangers may be supplied in parallel, in series or wholly independently. As previously commented, non-return valves may be provided to supplement the return of working fluid when it passes through the nozzles in the reverse flow direction. This refers to both the cool and intermediate exchangers, i.e., the two cool exchangers and the two intermediate exchangers.

Like FIG. 21, FIG. 22 shows a heater tube circulation arrangement in which the driving jet nozzle 206 for the hot end heater tubes 200 is at the periphery of the cylinder 112 and displacer 120. The material forming the flow turning surface, indicated by 235 in FIG. 21, may be carried up some distance from the vicinity of the turn to reduce scrubbing of the working fluid on the cylinder wall, thereby slightly reducing thermal conduction into and down the cylinder. The disc 208 is an almost flattened disc having a rim 211 which may have a suitable surface contour to induce a slight swirl to working fluid passing through nozzle 206.

Also, for any of the embodiments discussed, the cylinder wall thickness may be tapered down from the hot end towards the intermediate region, so that at any point the thickness matches the creep and/or strength properties at the local temperature for the material used. This may reduce conduction losses.

Figure 23:
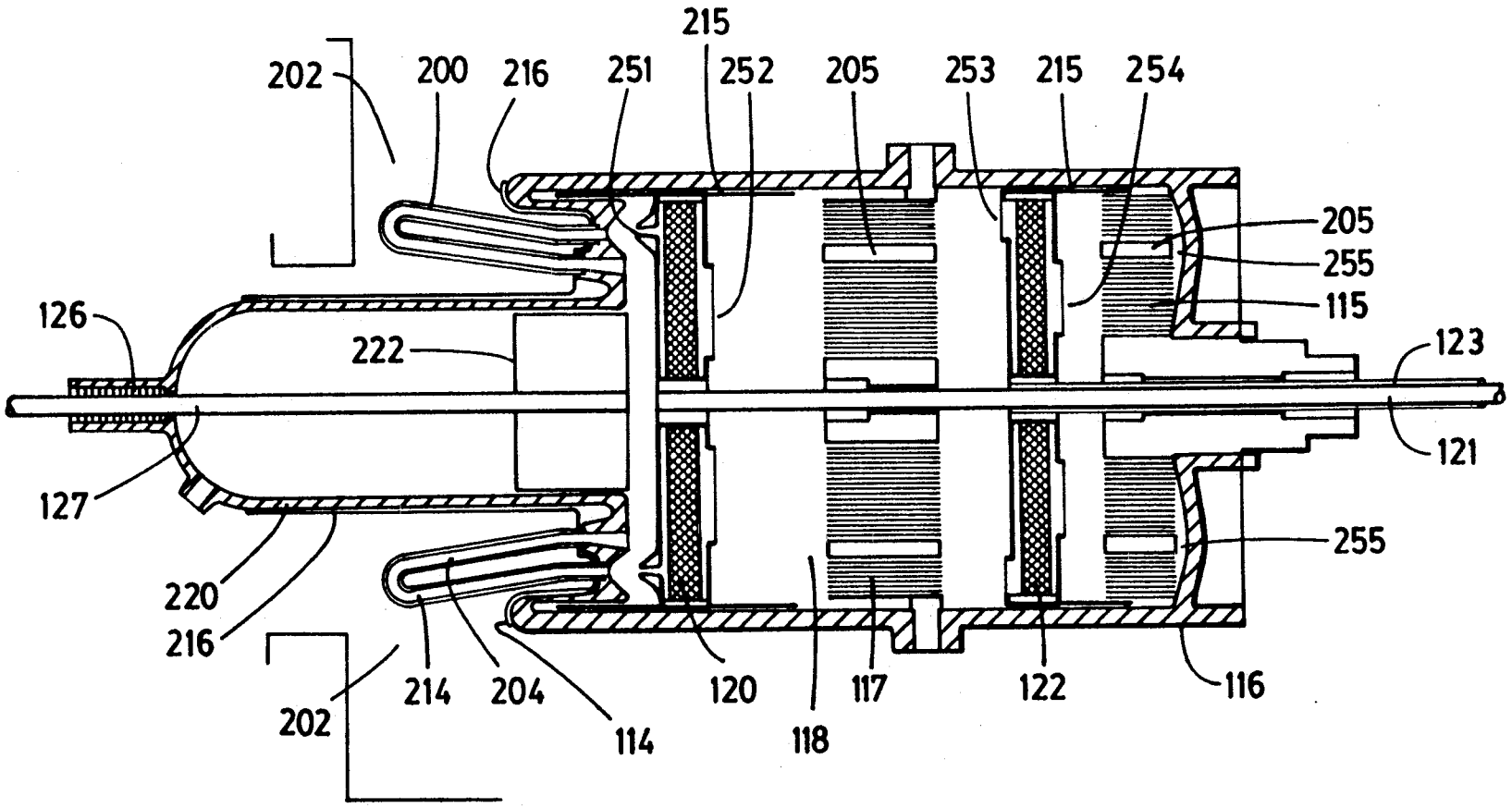
FIG. 23 is a longitudinal section of yet another practical embodiment of the invention.

FIG. 23 shows another embodiment of the self-driving machine according to the invention. However, unlike the machine of FIG. 20, this device does not rely on radial flow of working fluid as guided by large curved surfaces. Rather, working fluid flows in an axial pattern over heat exchangers 115 and 117, which substantially span the diameter of cylinder 112. Circulatory flow derives from the off-center placement of nozzles 251 and 252 on hot end displacer 120, and nozzles 253 and 254 on cool end displacer 122, respectively. The nozzles and the exit and entry points of the heat exchangers may have tapered edges for optimal flow of working fluid. Hollow spacers 205 interrupt heat exchangers 115, 117 to reduce interference of working fluid flow from opposing directions and to distribute service fluids. For example, in intermediate heat exchanger 117, spacer 205 positioned between nozzles 252 and 253 deflects opposing flow from these nozzles away from each other. Bulges 255 at the cool end 116 return working fluid that has exited nozzle 254 and passed over heat exchanger 115, back over heat exchanger 115 and, later, into nozzle 254. The tapered entry/exit points of heat exchanger 117 that are adjacent to these bulges 255 may have features that direct working fluid flow.

In this embodiment of the invention, thermal guards 215 are provided at the periphery of displacers 120, 122, such that they move with the displacers. These guards are constructed from a suitable material to minimize heat loss.

In another embodiment of the invention (not shown), off-center nozzles on the displacers and heat exchangers having axial flow passages, as shown in FIG. 23, are provided for a non-self-driving machine lacking a power piston cylinder extension. For both this machine and the machine of FIG. 23, the displacer rods 121 and 123 are not restricted to exiting the cylinder 112 from the cool end 116.

For certain applications, for example where the density of the hot end service is high enough to permit such, other embodiments of this device (not shown) may have a hot end heat exchanger system similar to that of the cool end shown in FIG. 23; these embodiments may or may not have a power piston cylinder extension. Moreover, devices having substantially axial flow passages are not restricted to a "straight cylinder" design. Alternatively, the hot and cool ends of such a device may be oriented at a 90° angle as in FIG. 3, or at some other angle, given that the heat exchanger means are appropriately curved. Certain embodiments of the invention (not shown) may also exist wherein working fluid flow is not simply directed radially or axially, but diametrally, sectorially, or otherwise.

The operation of even a small heat pump as a refrigerator, heater or both, will usually require a least two auxiliaries, i.e., a circulator for the low temperature (cold) heat supply, and one for the intermediate heat removal system. In most cases, too, power will be required for a fuel burning combustion system fan for the heat pump itself. A small amount of power will possibly also be required for instrumentation. A machine such as the invention described above, with the ability, in addition to driving itself, to supply power for its own auxiliaries or for other power uses would have great commercial attractiveness. Thus, it would be a two-purpose machine, both heat pump and power source.

I claim:

1. A thermal regenerative device having a constant volume with a one-phase working fluid distributed throughout, comprising displacers for dividing the volume into three chambers whose respective volumes are variable by movement of the displacers between them, a heat exchanger for each chamber in thermal contact with the working fluid, thermal regenerators in contact with the working fluid in the chambers, diffuser means arranged in fluid communication with the chambers and adapted to permit the passage of working fluid between the chambers, and means for the agitation of working fluid in at least one of the chambers.

2. The thermal regenerative device of claim 1, further comprising means for maintaining the working fluid in the three chambers respectively at a hot temperature, a cool temperature, and a temperature intermediate between the hot and cool temperatures.

3. The thermal regenerative device of claim 2, wherein the displacers are adapted such that their respective movement produces changes in overall pressure within the device.

4. The thermal regenerative device of claim 3, further comprising means for executing a programme of displacer movements such that net heat is transferred from the cool chamber to the intermediate temperature chamber.

5. The thermal regenerative device of claim 4, wherein the agitation means is a fan.

6. The thermal regenerative device of claim 4, wherein the agitation means is at least one forced flow nozzle for working fluid.

7. The thermal regenerative device of claim 4, wherein a plurality of nozzles are used, the nozzles being located in an extension of the respective chamber and being externally powered.

8. The thermal regenerative device of claim 4, wherein the agitation means comprises means to control and direct the flow or working fluid exiting from the diffuser means.

9. A thermal regenerative device having a constant volume with a one-phase working fluid distributed throughout, comprising displacers for dividing the volume into three chambers whose respective volumes are variable by movement of the displacers between them, a heat exchangers for each chamber in thermal contact with the working fluid, thermal regenerators in contact with the working fluid in the chambers, diffuser means arranged in fluid communication with the chambers and adapted to permit the passage of working fluid between the chambers, and surfaces located and contoured to increase thermal contact of the working fluid with the heat exchangers.

10. The thermal regenerative device of claim 9, further comprising means for maintaining the working fluid in the three chambers respectively at a hot temperature, a cool temperature, and a temperature intermediate between the hot and cool temperature.

11. The thermal regenerative device of claim 10, wherein the displacers are adapted such that their respective movement produces changes in overall pressure within the device.

12. The thermal regenerative device of claim 11, further comprising means for executing a programme of displacer movements such that net heat is transferred from the cool chamber to the intermediate temperature chamber.

13. The thermal regenerative device of claim 4 or 12, further comprising an extension chamber having a piston movable therein and means to transmit work between the piston and the displacers.

14. The thermal regenerative device of claim 13, further comprising means for using at least a portion of the work internally of the device.

15. The thermal regenerative device of claim 13, wherein the device is adapted such that at least a portion of the work can be used by means for using work externally of the device.

16. A thermal regenerative device comprising at least two of the devices of claims 4 or 12 and a heat source zone, wherein the hot chambers of the devices of claims 4 or 12 are in contact with the heat source zone.

17. The thermal regenerative device of claim 16, further comprising an extension chamber having a piston movable therein and means to transmit work between the piston and the displacers.

18. The thermal regenerative device of claim 17, wherein the extension chamber connects the respective hot chambers of the component devices.

19. The thermal regenerative device of claim 4 or 12, further comprising two cylinders, wherein respective internal first end chambers of each cylinder are connected to comprise the intermediate temperature chamber, and second end chambers of the cylinders comprise respective hot and cool chambers, the hot chamber being divided from the respective intermediate temperature chamber part by the hot end displacer and the cool chamber being divided from the respective intermediate temperature chamber part by the cool end displacer.

20. The thermal regenerative device of claim 19, wherein the cylinders are axially aligned.

21. The thermal regenerative device of claim 19, wherein the cylinders are located approximately perpendicular to each other.

22. The thermal regenerative device of claim 21, wherein the intermediate temperature chamber further comprises a crank chamber for respective connecting rods of the displacers.

23. A method of transferring heat energy from a low temperature region to a higher temperature region using a thermal regenerative device having a constant volume with a one-phase working fluid distributed throughout, displacers to divide the volume into three chambers whose respective volumes are variable by the movement of the displacers between them, a heat exchanger for each chamber in thermal contact with the working fluid, thermal regenerators in contact with the working fluid in the chambers, and diffuser means for the passage of working fluid between the chambers, wherein the working fluid in the three chambers is maintained respectively at a hot temperature, a cool temperature, and a temperature intermediate between the hot and cool temperatures, said method comprising the steps of:

moving the displacers cyclically to raise and reduce overall pressure within the device with delivery of at least part of the heat of compression through the heat exchanger for the intermediate temperature chamber and with abstraction of at least part of the heat of expansion from the cool chamber, to abstract heat substantially isothermally from each of the hot chamber and the cool chamber and to deliver heat substantially isothermally to the heat exchanger for the intermediate temperature chamber;

and agitating working fluid in at least one of the chambers to increase thermal contact of the working fluid with the respective heat exchanger.

24. The method of claim 23, wherein a first said displacer is a hot end displacer located between the hot and intermediate temperature chambers and a second said displacer is a cool end displacer located between the cool and intermediate temperature chambers, wherein said moving Step further comprises the cycle of:

moving the cool end displacer to enlarge the cool chamber, whereby a minor amount of heat is abstracted from the cool chamber to maintain the temperature of the cool chamber and to supply heat of expansion thereof;

moving the hot end displacer to substantially decrease the volume of the hot chamber, whereby a major amount of heat is abstracted from the cool chamber and overall pressure within the device is decreased;

moving the cool end displacer to reduce the cool chamber; and moving the hot end displacer to enlarge the hot chamber, whereby overall pressure within the device is increased and heat of compression is rejected through the heat exchanger for the intermediate temperature chamber.

25. The method of claim 24, wherein the fluid in the hot chamber is agitated.

26. The method of claim 24, wherein the fluid in the cool chamber is agitated.

27. The method of claim 24, wherein the fluid in the intermediate temperature chamber is agitated.

28. The method of claim 24, wherein agitation of working fluid is by means of a circulating fan.

29. The method of claim 24, wherein the agitation step includes forcing circulation of working fluid through at least one nozzle.

30. The method of claim 29, wherein said forced circulation step includes a plurality of nozzles, the nozzles being located in an extension of the respective chamber and being externally powered.

31. The method of claim 24, wherein the agitation step includes controlling and directing the flow of working fluid exiting from the diffuser means.

32. The method of claim 24, wherein an extension cylinder having a piston movable therein is provided, said method further comprising the step of transmitting work between the piston and the displacers.

33. The method of claim 24, wherein an extension cylinder having a piston movable therein is provided, said method further comprising the step of transmitting work from the piston for use internally of the device.

34. The method of claim 24, wherein an extension cylinder having a piston movable therein is provided, said method further comprising the step of transmitting work from the piston for use externally of the device.

* * * * *

UNITED STATES PATENT AND TRADEMARK OFFICE

CERTIFICATE OF CORRECTION

PATENT NO. : 5,301,506

DATED : April 12, 1994

INVENTOR(S) : Tom K. Pettingill

It is certified that error appears in the above-identified patent and that said Letters Patent is hereby corrected as shown below:

In column 2, line 44 change "correlation" to --circulation--.

In claim 8, column 21, line 10 change "or" to --of--.

In claim 9, column 21, line 17 change "exchangers" to --exchanger--.

In claim 10, column 21, line 29, change "temperature." to --temperatures.--.

In claim 17, column 21, line 56, change "to transmit" to --for transmitting--.

Signed and Sealed this

Twentieth Day of December, 1994

*Attest:*

Bruce Lehman

BRUCE LEHMAN

*Attesting Officer*

*Commissioner of Patents and Trademarks*